US012710214B2

(12) United States Patent
Oh et al.

(10) Patent No.: US 12,710,214 B2
(45) **Date of Patent: *Aug. 18, 2026**

(54) REFRIGERATOR

(71) Applicant: LG Electronics Inc., Seoul (KR)

(72) Inventors: Minkyu Oh, Seoul (KR); Heayoun Sul, Seoul (KR); Hyoungkeun Lim, Seoul (KR); Jeehoon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

This patent is subject to a terminal disclaimer.

(21) Appl. No.: 18/762,962

(22) Filed: Jul. 3, 2024

(65) Prior Publication Data

US 2024/0353163 A1 Oct. 24, 2024

Related U.S. Application Data

(63) Continuation of application No. 18/113,232, filed on Feb. 23, 2023, now Pat. No. 12,066,237, which is a (Continued)

(30) Foreign Application Priority Data

Mar. 21, 2017 (KR) ..... 10-2017-0035609

(51) Int. Cl.

| | |
|---|---|
| ***F25D 17/06*** | (2006.01) |
| ***F25B 21/02*** | (2006.01) |
| ***F25D 23/00*** | (2006.01) |

(52) U.S. Cl.
CPC ..... *F25D 17/062* (2013.01); *F25B 21/02* (2013.01); *F25D 23/006* (2013.01); (Continued)

(58) Field of Classification Search
CPC ..... F25B 21/02; F25B 2321/023; F25B 2321/0251; F25D 3/00; F25D 11/006; (Continued)

(56) References Cited

U.S. PATENT DOCUMENTS 3,307,365 A * 3/1967 Townsend ..... F25B 21/02 62/3.6
5,501,076 A * 3/1996 Sharp, III ..... F25B 21/02 62/3.2

(Continued)

*Primary Examiner* — Cassey D Bauer
(74) *Attorney, Agent, or Firm* — Fish & Richardson P.C.

(57) ABSTRACT

A refrigerator includes: an inner case having a storage chamber; a thermoelectric module including a thermoelectric element and a cooling sink; a fan configured to circulate air, to the storage chamber; a fan cover configured to cover the fan and having an upper discharge hole, a lower discharge hole, and an inner suction hole formed between the upper discharge hole and the lower discharge hole; a first receiving member disposed in the storage chamber; and a second receiving member disposed over the first receiving member to be spaced apart from the first receiving member. At least a portion of each of the inner suction hole and the lower discharge hole faces a portion between the first receiving member and the second receiving member, and at least a portion of the upper discharge hole faces a portion between a top surface of the storage chamber and the second receiving member.

19 Claims, 20 Drawing Sheets

Related U.S. Application Data continuation of application No. 17/859,309, filed on Jul. 7, 2022, now Pat. No. 11,629,903, which is a continuation of application No. 16/496,296, filed as application No. PCT/KR2018/002675 on Mar. 6, 2018, now Pat. No. 11,402,144.

(52) U.S. Cl.
CPC . *F25B 2321/023* (2013.01); *F25B 2321/0251* (2013.01); *F25D 2317/066* (2013.01); *F25D 2317/0671* (2013.01)

(58) Field of Classification Search
CPC ..... F25D 17/08; F25D 2323/0021; F25D 2323/00262; F25D 17/062; F25D 23/006; F25D 2317/066; F25D 2317/0671; F25D 2317/0654; F25D 2317/065; F25D 17/067; F25D 2317/0672; F25D 2323/00276; F25D 2323/00271; F25D 21/02; F25D 25/025; F25D 17/065
See application file for complete search history.

(56) References Cited

U.S. PATENT DOCUMENTS

2006/0185711 A1* 8/2006 Bang ..... F25B 21/02 136/230
2018/0252466 A1* 9/2018 Baker ..... B01L 7/52

* cited by examiner

REFRIGERATOR

CROSS-REFERENCE TO RELATED APPLICATIONS

This application is a continuation of U.S. application Ser. No. 18/113,232, filed on Feb. 23, 2023, which is a continuation of U.S. application Ser. No. 17/859,309, filed on Jul. 7, 2022, now U.S. Pat. No. 11,629,903, which is a continuation of U.S. application Ser. No. 16/496,296, filed on Sep. 20, 2019, now U.S. Pat. No. 11,402,144, which is a National Stage application under 35 U.S.C. § 371 of International Application No. PCT/KR2018/002675, filed on Mar. 6, 2018, which claims the priority benefit of Korean Patent Application No. 10-2017-0035609, filed on Mar. 21, 2017. The disclosures of the prior application are incorporated by reference in their entirety.

TECHNICAL FIELD

The present invention relates to a refrigerator and, more particularly, to a refrigerator of which a storage chamber is cooled by a thermoelectric module.

BACKGROUND ART

A refrigerator is an apparatus that prevents food or medicine from rotting and spoiling by keeping them at low temperature.

A refrigerator includes a storage chamber that keeps food or medicine, and a cooling device that cools the storage chamber.

The cooling device, for example, may be a refrigeration cycle device including a compressor, a condenser, an expansion unit, and an evaporator.

Alternatively, the cooling device, for example, may be a thermoelectric module (TEM) that uses a phenomenon in which a temperature difference is generated at both cross-sections of different metals coupled to each other when a current is applied to the metals.

The refrigeration cycle device has a defect that efficiency is high but noise is large when the compressor is driven, as compared with the thermoelectric module.

However, the thermoelectric module, as compared with the refrigeration cycle device, is low in efficiency, but has the advantage of small noise and can be used for a CPU cooler, automotive temperature control seats, small refrigerators, etc.

As technical document related to the present invention, there are KR 1999-0017197 U (published on 1999 May 25) and KR 2000-0015921 U (published on 2000 Aug. 16).

SUMMARY

An object of the present invention is to provide a refrigerator having refrigeration performance improved by forcibly convecting cold air.

Another object of the present invention is to provide a refrigerator in which air smoothly circulates in a storage chamber and temperature distribution is uniform in the storage chamber.

Another object of the present invention is to provide a refrigerator having a small height and a compact size.

A refrigerator according to an embodiment of the present invention may include: an inner case having a storage chamber; a thermoelectric module configured to cool the storage chamber and including a thermoelectric element and a cooling sink; a fan configured to circulate air, which has exchanged heat with the cooling sink, to the storage chamber; a fan cover configured to cover the fan and having an upper discharge hole, a lower discharge hole, and an inner suction hole formed between the upper discharge hole and the lower discharge hole; a first receiving member disposed in the storage chamber; and a second receiving member disposed over the first receiving member to be spaced apart from the first receiving member. At least a portion of each of the inner suction hole and the lower discharge hole may face a portion between the first receiving member and the second receiving member, and at least a portion of the upper discharge hole may face a portion between a top surface of the storage chamber and the second receiving member.

A spaced distance between the first receiving member and the second receiving member may be longer than a distance between the top surface of the storage chamber and the second receiving member.

An up-down directional height of the first receiving member may be larger than an up-down directional height of the second receiving member.

The inner suction hole may be formed closer to the lower discharge hole than the upper discharge hole.

A lower end of the lower discharge hole may be positioned behind and above the first receiving member.

The inner suction hole may not horizontally overlap each of the first receiving member and the second receiving member.

A portion of the upper discharge hole horizontally may overlap the second receiving member.

An upper end of the upper discharge hole may be positioned behind and above the first receiving member.

A height difference between an upper end of the upper discharge hole and an upper end of the second receiving member may be the same as a height difference between a lower end of the lower discharge hole and an upper end of the first receiving member.

At least a portion of a rear surface, which faces the upper discharge hole, of the second receiving member may be formed to be inclined upward.

A front-rear length of the first receiving member may be larger than a front-rear length of the second receiving member.

A spaced distance between the second receiving member and a rear surface of the storage chamber may be longer than a spaced distance between the first receiving member and the rear surface of the storage chamber.

A sump of areas of the upper discharge hole and the lower discharge hole may be 1.3 times or more and 1.5 times or less an area of the inner suction hole.

A refrigerator according to an embodiment of the present invention may include: an inner case having a storage chamber and having a height of 400 mm or more and 700 mm or less; a thermoelectric module configured to cool the storage chamber and including a thermoelectric element and a cooling sink; a fan configured to circulate air, which has exchanged heat with the cooling sink, to the storage chamber; a fan cover configured to cover the fan and having an upper discharge hole, a lower discharge hole, and an inner suction hole formed between the upper discharge hole and the lower discharge hole; a first receiving member disposed in the storage chamber; and a second receiving member disposed over the first receiving member to be spaced apart from the first receiving member. At least a portion of each of the inner suction hole and the lower discharge hole may face a portion between the first receiving member and the second receiving member, and at least a portion of the upper discharge hole may face a portion between a top surface of the storage chamber and the second receiving member.

The inner suction hole may be formed closer to the lower discharge hole than the upper discharge hole.

A portion of the upper discharge hole may horizontally overlap the second receiving member, and at least a portion of a rear surface, which faces the upper discharge hole, of the second receiving member may be formed to be inclined upward.

According to an embodiment of the present invention, the cooling fan generates forcible conduction in which the air in the storage chamber is cooled at the cooling sink of the thermoelectric module and is then discharged back into the storage chamber, the refrigeration performance of the refrigerator can be improved.

Further, since the air cooled at the cooling sink is discharged to the upper discharge hole and the lower discharge hole, air circulation becomes active and temperature distribution can be made uniform in the storage chamber.

Further, since the inner suction hole and the lower discharge hole are configured not to horizontally face the receiving members, air circulation becomes active in the storage chamber, so the refrigeration performance of the refrigerator can be further improved.

Further, when the second receiving member horizontally overlaps a portion of the inner suction hole, the horizontal spacing direction between the second receiving member and the inner suction hole is secured, so the air circulation in the storage chamber can be maintained smooth. Further, since a portion of the upper discharge hole horizontally overlaps the second receiving member, smooth air circulation can be maintained in the storage chamber and the height of the storage chamber can be decreased. Accordingly, there is the advantage in that the height of the refrigerator can be decreased, so the refrigerator can be made compact.

DETAILED DESCRIPTION

Hereinafter, specific embodiments of the present invention are described in detail with reference to drawings.

Figure 1:
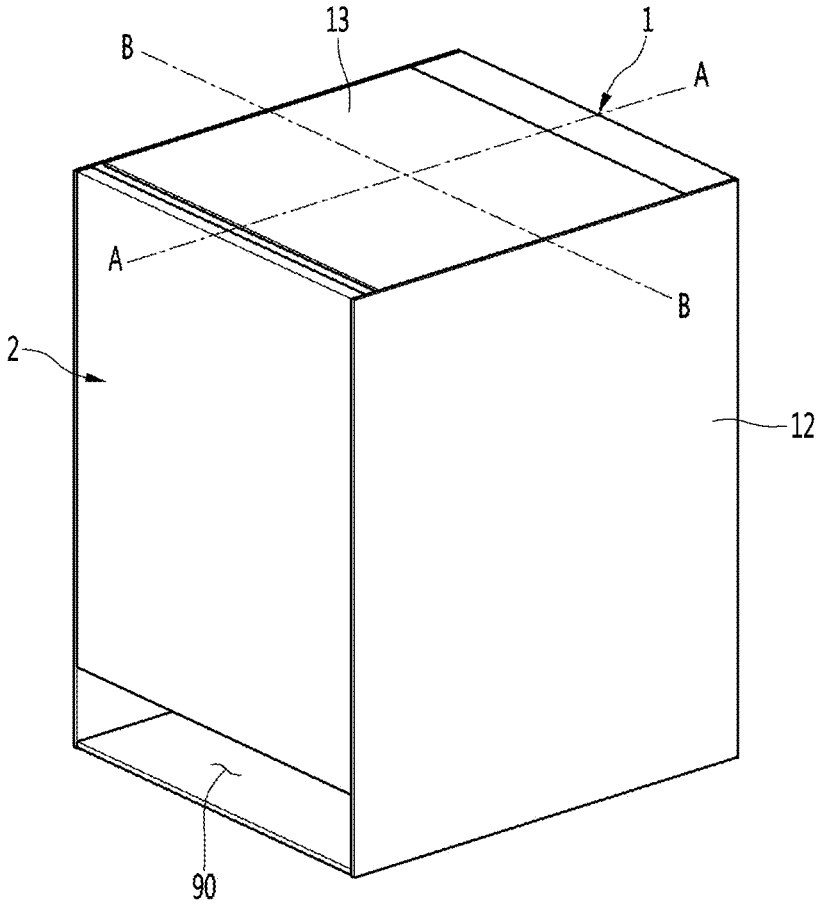
FIG. 1 is a perspective view of the external appearance of a refrigerator according to an embodiment of the present invention.
Figure 2:
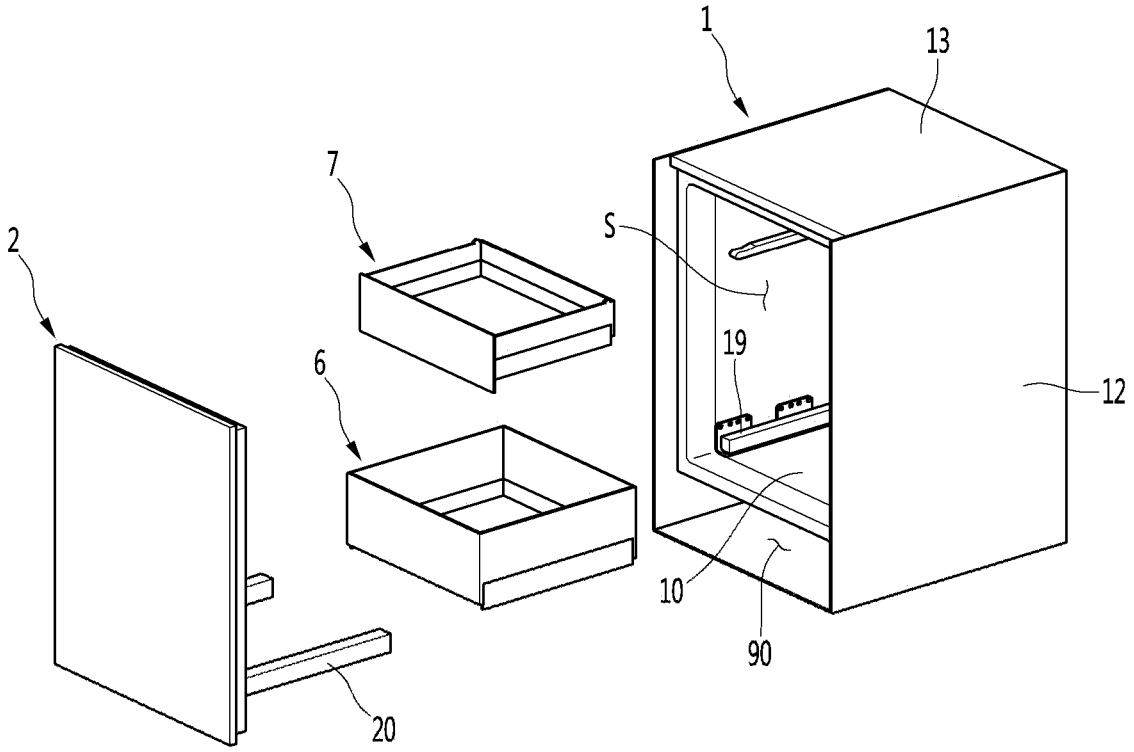
FIG. 2 is an exploded perspective view in which a main body, a door, and a receiving member of the refrigerator according to an embodiment of the present invention are separated.
Figure 3:
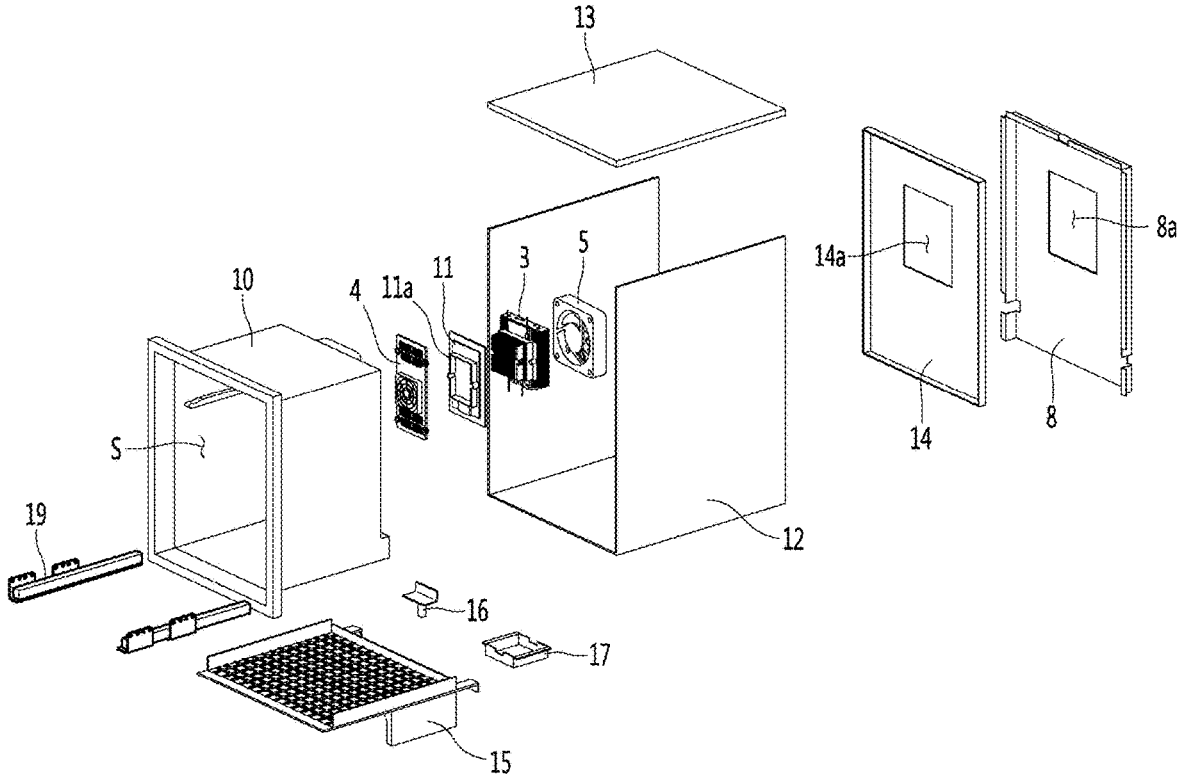
FIG. 3 is an exploded perspective view of the main body of the refrigerator according to an embodiment of the present invention.
Figure 4:
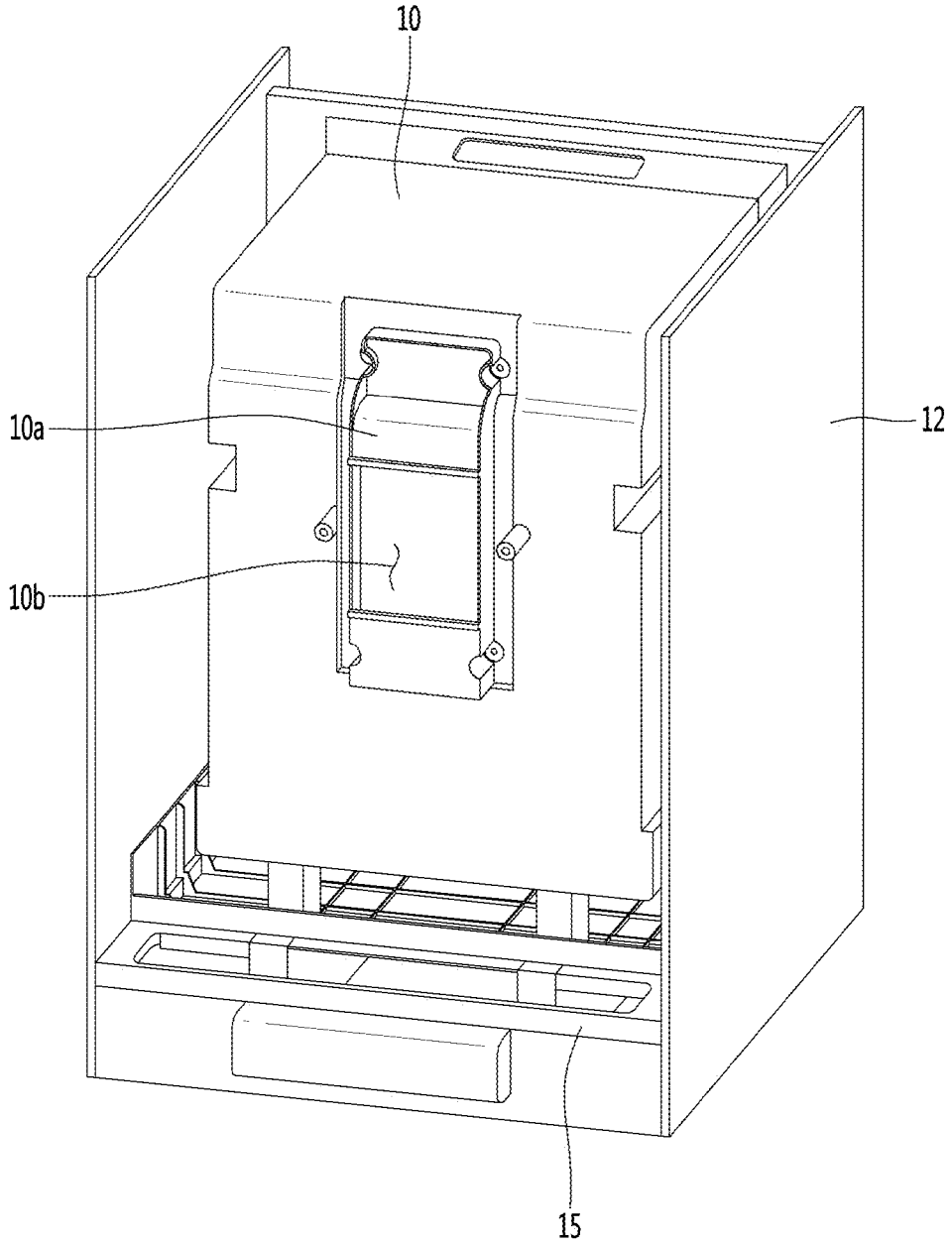
FIG. 4 is a perspective view showing the rear surface of an inner case according to an embodiment of the present invention.

FIG. 1 is a perspective view of the external appearance of a refrigerator according to an embodiment of the present invention, FIG. 2 is an exploded perspective view in which a main body, a door, and a receiving member of the refrigerator according to an embodiment of the present invention are separated, FIG. 3 is an exploded perspective view of the main body of the refrigerator according to an embodiment of the present invention, and FIG. 4 is a perspective view showing the rear surface of an inner case according to an embodiment of the present invention.

Hereafter, a side-table refrigerator is exemplified as a refrigerator according to an embodiment of the present invention. The side-table refrigerator may have the function of a side table other than the function of keeping food. Unlike common refrigerators that are installed at a kitchen, the side-table refrigerator may be installed and used at a side of a bed in a bedroom. Accordingly, it is preferable that the height of the side-table refrigerator is similar to the height of a bed for the convenience of a user, and the side-table refrigerator may be formed in a compact size with a small height in comparison to common refrigerators.

However, the present invention is not described thereto and it is apparent to those skilled in the art that the present invention can be applied to other types of refrigerators.

Referring to FIGS. 1 to 4, a refrigerator according to an embodiment of the present invention may include a main body 1 having a storage chamber S, a door 2 opening/closing the storage chamber S, and a thermoelectric module 3 cooling the storage chamber S.

The main body 1 may be formed in a box shape. It is preferable that the main body 1 has a height of 400 mm or more and 700 mm or less to be able to be used as a side table. That is, the height of the refrigerator may be 400 mm or more and 700 mm or less.

The top surface of the main body 1 may be horizontal and a user can use the top surface of the main body 1 as a side table.

The main body 1 may be configured as an assembly of a plurality of members.

The main body 1 may include an inner case 1, a cabinet 12, 13, 14, a cabinet bottom 15, a drain pipe 16, and a tray 17. The main body 1 may further include a PCB cover 18 and a heat dissipation cover 8.

The storage chamber S may be provided for the inner case 10. The storage chamber S may be formed inside the inner case 10. A surface of the inner case 10 may be open and the open surface can be opened/closed by the door 2. Preferably, the front surface of the inner case 10 may be open.

A thermoelectric module seat 10*a* may be formed on the rear surface of the inner case 10. The thermoelectric module seat 10*a* may be formed by protruding rearward a portion of the rear surface of the inner case 10. The thermoelectric module seat 10*a* may be formed closer to the top surface than the bottom surface of the inner case 10.

A cooling channel S1 (see FIG. 16) may be disposed inside the thermoelectric module seat 10*a*. The cooling channel S1 is an internal space of the thermoelectric module seat 10*a* and may communicate with the storage chamber S.

Further, a thermoelectric module seat hole 10*b* may be formed in the thermoelectric module seat 10*a*. The cooling sink 32 of the thermoelectric module 3 to be described below may be at least partially disposed in the cooling channel S1.

The cabinet 12, 13, 14 may form the external appearance of the refrigerator.

The cabinet 12, 13, 14 may be disposed to surround the outer side of the inner case 10. The cabinet 12, 13, 14 may be disposed to be spaced apart from the inner case 10 and a foaming material may be inserted between the cabinets 12, 13, and 14 and the inner case 10.

The cabinet 12, 13, 14 may be formed by combining a plurality of members. The cabinet 12, 13, 14 may include an outer cabinet 12, a top cover 13, and a back plate 14.

The outer cabinet 12 may be disposed outside the inner case 10. In more detail, the outer cabinet 12 may be disposed at the left and right sides of and under the inner case 10. However, the positional relationship of the outer cabinet 12 and the inner case 10 may be changed, if necessary.

The outer cabinet 12 may be disposed the cover the left side, the right side, and the bottom of the inner case 10. The outer cabinet 12 may be disposed to be spaced apart from the inner case 10.

The outer cabinet 12 may configure the left side, the right side, and the bottom of the refrigerator.

The outer cabinet 12 may be composed of a plurality of members. The outer cabinet 12 may include a base forming the external appearance of the bottom of the refrigerator, a left cover disposed on the left side of the base, and a right cover disposed on the right side of the base. In this case, the material of at least one of the base, the left cover, or the right cover may be different. For example, the base may be made of synthetic resin, and the left plate and the right plate may be made of metal such as steel or aluminum.

The outer cabinet 12 may be formed by a single member, and in this case, the outer cabinet 12 may have a bottom plate, a left plate, and a right plate that are curved or bent. When the outer cabinet 12 is formed by one member, it may be made of metal such as steel or aluminum.

The top cover 13 may be disposed over the inner case 10. The top cover 13 may form the top surface of the refrigerator. A user can use the top surface of the top cover 13.

The top cover 13 may be manufactured in a plate shape and may be made of wood. Accordingly, it is possible to make the external appearance of the refrigerator more elegant. Further, since wood is used for common side tables, a user can more intuitionally feel the use as a side table of the refrigerator.

The top cover 13 may be disposed to cover the top surface of the inner case 10. At least a portion of the top cover 13 may be disposed to be spaced apart from the inner case 10.

The top surface of the top cover 13 may be disposed to be level with the upper end of the outer cabinet 12. The left-right directional width of the top cover 13 may be the same as the left-right direction inner width of the outer cabinet 12. The left side and the right side of the top cover 13 may be disposed in contact with the inner surface of the outer cabinet 12.

The back plate 14 may be vertically disposed. The back plate 14 may be disposed behind the inner case 10 and under the top cover 13. The back plate 14 may be disposed to face the rear side of the inner case 10 in the front-rear direction.

The back plate 14 may be disposed in contact with the inner case 10. The back plate 14 may be disposed close to the thermoelectric module seat 10*a* of the inner case 10.

A through-hole 14*a* may be formed in the back plate 14. The through-hole 14*a* may be formed at a position corresponding to the thermoelectric module seat hole 10*b* of the inner case 10. The size of the through-hole 14*a* may be the same as or larger than the size of the thermoelectric module seat hole 10*b* of the inner case 10.

The cabinet bottom 15 may be disposed under the inner case 10. A cabinet bottom 15 can support the inner case 10 under the inner case 10.

The cabinet bottom 15 may be disposed between the outer bottom surface of the inner case 10 and the inner bottom surface of the outer cabinet 12. The cabinet bottom 15 can space the inner case 10 from the inner bottom surface of the outer cabinet 12. The cabinet bottom 15 may form a lower heat dissipation channel 92 (see FIG. 16) in cooperation with the inner surface of the outer cabinet 12.

The drain pipe 16 may communicate with the storage chamber S. The drain pipe 16 may be connected to the lower portion of the inner case 10 and can discharge water produced by defrosting, etc. in the inner case 10.

The tray 17 may be positioned under the drain pipe 16 and can accommodate water dropped from the drain pipe 16.

The tray 17 may be disposed between the cabinet bottom 15 and the outer cabinet 12. The tray 17 may be positioned in the lower heat dissipation channel 92 (see FIG. 16) to be described below and the water accommodated in the tray 17 can be evaporated by high-temperature air guided into the lower heat dissipation channel 92. Due to this configuration, there is an advantage in that it is not required to frequently exhaust the water in the tray 17.

The heat dissipation cover 8 may be disposed behind the back plate 14 to face the back plate 14 in the front-rear direction. The heat dissipation cover 8 may be disposed to be spaced apart from the back plate 14.

The upper end of the heat dissipation cover 8 may be spaced apart from the top cover 13. That is, the height of the heat dissipation cover 8 may be lower than the outer cabinet 12. In this case, the PCB cover 18 to be described below can be exposed rearward from the main body 1.

However, the present invention is not limited thereto and the heat dissipation cover 8 may be disposed such that the upper end thereof is in contact with the top cover 13. In this case, the PCB cover 18 may not be exposed rearward from the main body 1 by being positioned ahead of the heat dissipation cover 8.

An external air intake hole 8*a* may be formed in the heat dissipation cover 8. The external air intake hole 8*a* may be formed at a position corresponding to the thermoelectric module seat hole 10*b* of the inner case 10 and the through-hole 14*a* of the back plate 14. The external air intake hole 8*a* may face the heat dissipation fan 5 to be described below in the front-rear direction.

An intake grill (not shown) may be mounted in the external air intake hole 8*a*.

The heat dissipation cover 8 may form a rear heat dissipation channel 91 (see FIG. 16) in cooperation with the back plate 14. The rear heat dissipation channel 91 may be positioned between the front surface of the heat dissipation cover 8 and the rear surface of the back plate 14.

When the heat dissipation fan 5 to be described below is driven, the air outside the refrigerator can be suctioned into the refrigerator through the external air intake hole 8*a*. The air suctioned into the external air intake hole 8*a* can be heated through heat exchange in the heat sink 33 and can be guided to the rear heat dissipation channel 91. This will be described below.

The PCB cover 18 can cover a controller 18*a*. The controller 18*a* may include electronic parts such as a PCB. The controller 18*a* can receive and store measurement values of sensors of the refrigerator. The controller 18*a* can control the thermoelectric module 3, the cooling fan 4, and the heat dissipation fan 5. The controller 18*a* can further control additional components, if necessary.

The PCB cover 18 may be disposed at the upper portion of or ahead of the heat dissipation cover 8. The PCB cover 18 can cover the rear and/or the top of the controller 18*a*.

The PCB cover 18 may be disposed under the top cover 13 and may be disposed behind the inner case 10. Further, the PCB cover 18 may be disposed over the heat sink 33 of the thermoelectric module 3 to be described below and/or over the heat dissipation fan 5.

The example, when the upper end of the heat dissipation cover 8 is spaced apart from the top cover 13, the PCB cover 18 can cover the rear of the controller 18*a*. Accordingly, it is possible to prevent the controller 18*a* from being exposed rearward from the main body 1.

On the contrary, when the upper end of the heat dissipation cover 8 is in contact with the top cover 13, the controller 18*a* is not exposed rearward from the main body 1 by the heat dissipation cover 8, so the PCB cover 18 can cover the top of the controller 18*a* without covering the rear of the controller 18*a*.

On the other hand, the door 2 can open/close the storage chamber S. The door 2 can be coupled to the main body 1, and the coupling type and the number are not limited. For example, the door 2 may be a single one-directional door or a plurality of bidirectional doors that can be opened/closed by hinges. Hereafter, an example in which the door 2 is a drawer type door that is coupled to the main body 1 to be able to slide in the front-rear direction is described.

The door 2 may be coupled to the front surface of the main body 1. The door 2 can cover the open front surface of the inner case 10, thereby being able to open/close the storage chamber S.

The door 2 may be made of wood but is not limited thereto.

The up-down directional height of the door 2 may be smaller than the height of the outer cabinet 12. The lower end portion of the door 2 may be disposed to be spaced apart from the inner bottom surface of the outer cabinet 12.

A heat dissipation channel outlet 90 that communicates with the lower heat dissipation channel 92 (see FIG. 16) may be formed between the lower end of the door 2 and the lower end of the outer cabinet 12.

The door 2 may be coupled to the main body 1 in a sliding type. The door 2 may have a pair of sliding members 20 and the sliding members 20 are slidably fastened to a pair of sliding rails 19 of the storage chamber S, so the sliding members 20 can slide. Accordingly, the door 2 can slide forward and rearward while maintaining the state in which it faces the open front surface of the inner case 10.

The sliding rails 19 may be disposed on the left inner surface and the right inner surface of the inner case 10. The sliding rails 19 may be disposed at positions closer to the bottom surface than the top surface of the inner case 10.

A user can open the storage chamber S by pulling the door 2 and can close the storage chamber S by pushing the door 2.

Meanwhile, the refrigerator may include at least one receiving members 6 and 7 disposed in the storage chamber S.

The kinds of the receiving members 6 and 7 are not limited. For example, the receiving members 6 and 7 may be shelves or drawers. Hereafter, the case in which the receiving members 6 and 7 are drawers is described.

Food can be placed on or received in the receiving members 6 and 7.

The receiving members 6 and 7 may be configured to be able to slide in the front-rear direction. At least a pair of receiving member rails corresponding to the number of the receiving members 6 and 7 may be disposed on the left inner surface and the right inner surface of the inner case 10, and the receiving members 6 and 7 may be slidably fastened to the receiving member rails, respectively.

The receiving members 6 and 7 may be configured to move together with the door 2. For example, the receiving members 6 and 7 may be separably coupled to the door 2 by a magnet. In this case, when a user opens the storage chamber S by pulling the door 2, the receiving members 6 and 7 can be moved forward together with the door 2. The receiving members 6 and 7 may be configured to be independently moved without moving together with the door 2.

The receiving members 6 and 7 may be horizontally disposed in the storage chamber S.

The top surfaces of the receiving members 6 and 7 may be open and food can be received in the receiving members 6 and 7.

The receiving members 6 and 7 may include a first receiving member 6 and a second receiving member 7. The first receiving member 6 may be disposed lower than the second receiving member 7.

The front-rear directional lengths of the first receiving member 6 and the second receiving member 7 may be the same as or different from each other. Further, the up-down direction heights of the first receiving member 6 and the second receiving member 7 may be the same as or different from each other.

On the other hand, the thermoelectric module 3 can cool the storage chamber S. The thermoelectric module 3 can keep the temperature of the storage chamber S low using Peltier effect.

The thermoelectric module 3 may be disposed forward further than the heat dissipation cover 3.

Figure 6:
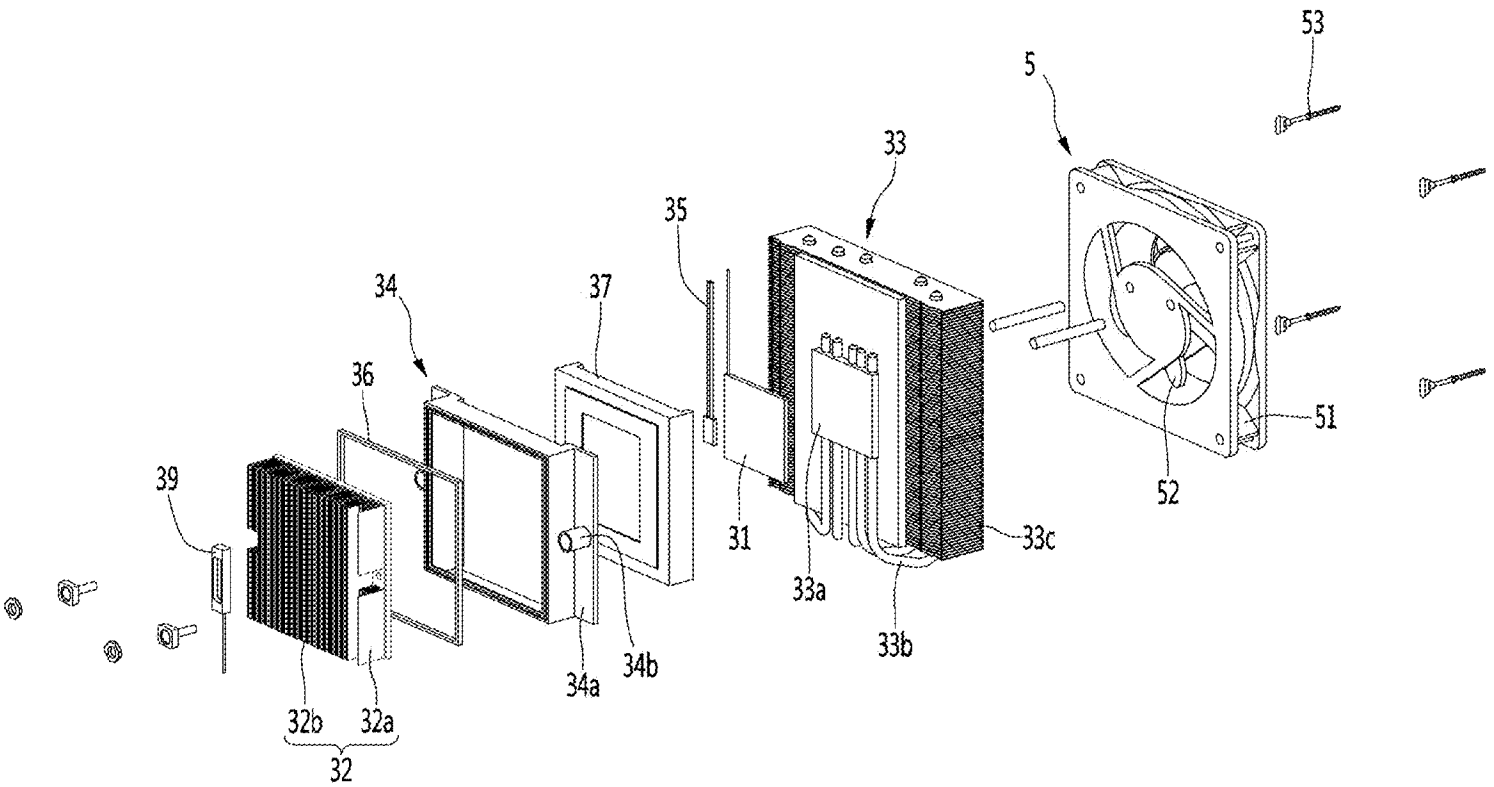
FIG. 6 is an exploded perspective view of the thermoelectric module and the heat dissipation fan shown in FIG. 5.

The thermoelectric module 3 may include a thermoelectric element 31 (see FIG. 6), a cooling sink 32 (see FIG. 6), and a heat sink 33 (see FIG. 6).

The thermoelectric element 31 may include a low-temperature portion and a high-temperature portion, and the low-temperature portion and the high-temperature portion may be determined in accordance with the direction of a voltage that is applied to the thermoelectric element 31. Further, the temperature difference between the low-temperature portion and the high-temperature portion may be determined in accordance with the voltage that is applied to the thermoelectric element 31.

The thermoelectric element 31 may be disposed between the cooling sink 32 and the heat sink 33 and may be in contact with the cooling sink 32 and the heat sink 33.

The low-temperature portion of the thermoelectric element 31 may be in contact with the cooling sink 32 and the high-temperature portion of the thermoelectric element 31 may be in contact with the heat sink 33.

The detail configuration of the thermoelectric module 3 will be described in detail below.

On the other hand, the refrigerator may further include a cooling fan 4 that circulates air to the cooling sink 32 of the thermoelectric module 3 and the storage chamber S. The refrigerator may further include a heat dissipation fan 5 that sends external air to the heat sink 33 of the thermoelectric module 3.

The cooling fan 4 may be disposed ahead of the thermoelectric module 3 and the heat dissipation fan 5 may be disposed behind the thermoelectric module 3. The cooling fan 4 may be disposed to face the cooling sink 32 in the front-rear direction and the heat dissipation fan 5 may be disposed to face the heat sink 33 in the front-rear direction.

The cooling fan 4 may be formed inside the inner case 10. The cooling fan 4 can send air in the storage chamber S to the cooling channel S1 (see FIG. 16) and low-temperature air that has exchanged heat with the cooling sink 32 disposed in the cooling channel 1 can keep the temperature of the storage chamber S low by flowing back into the storage chamber S.

The heat dissipation fan 5 can suction external air through the external air intake hole 8*a* formed in the heat dissipation cover 8. The air suctioned by the heat dissipation fan 5 exchanges heat with the heat sink 33 positioned between the back plate 14 and the heat dissipation cover 8 and can dissipate heat of the heat sink 33. The high-temperature air that has exchanged heat with the heat sink 33 can be guided sequentially to the rear heat dissipation channel 91 (see FIG. 16) and the lower heat dissipation channel 92 (see FIG. 16) and then discharged to the heat dissipation channel outlet 90 positioned under the door 2.

The heat dissipation fan 5 may be formed in a size corresponding to the external air intake hole 8*a* formed in the heat dissipation cover 8. The heat dissipation fan 5 may be disposed to face the external air intake hole 8*a*.

The detailed configuration of the cooling fan 4 and the heat dissipation fan 5 will be described below.

Figure 5:
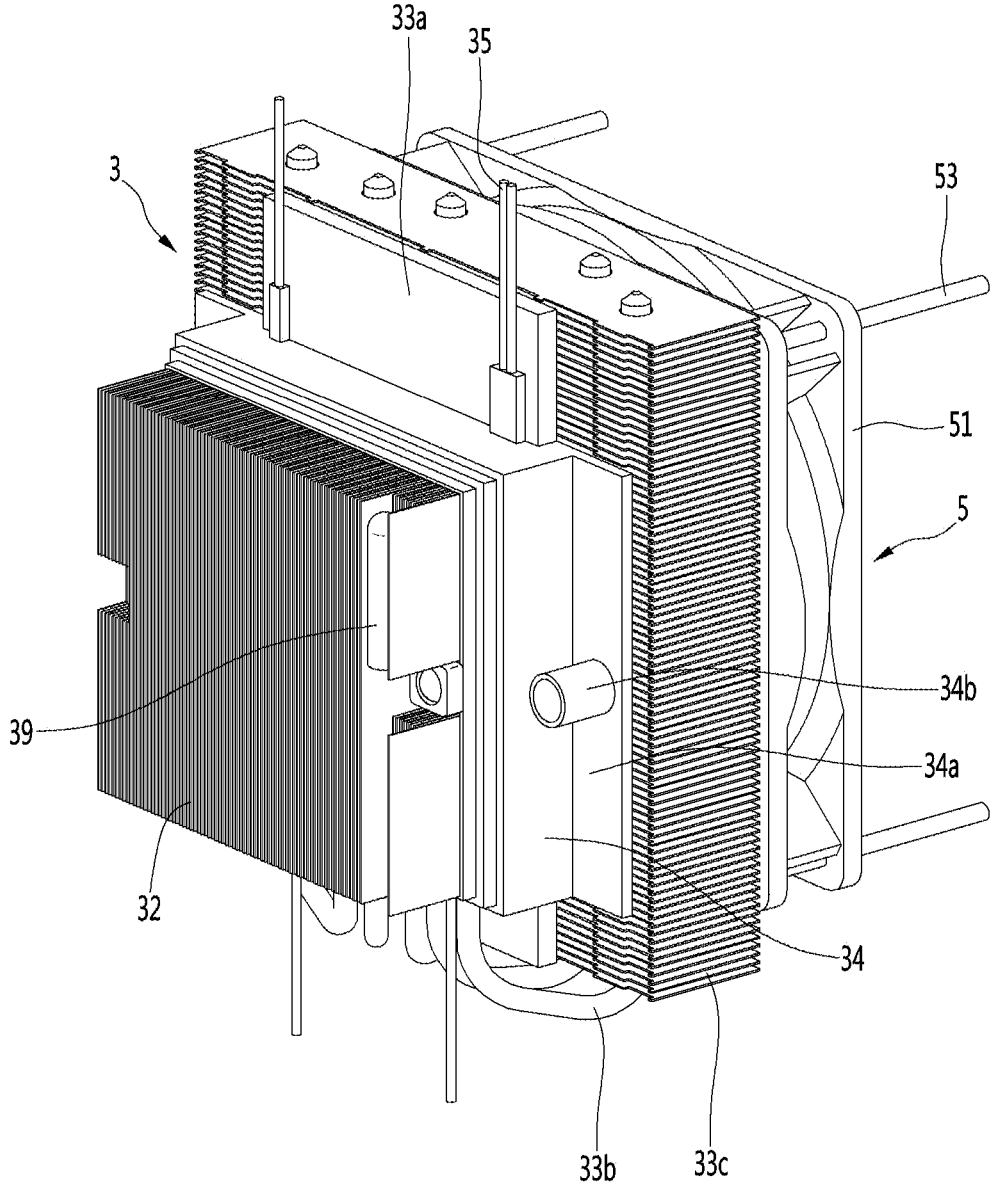
FIG. 5 is a perspective view showing a thermoelectric module and a heat dissipation fan according to an embodiment of the present invention.
Figure 7:
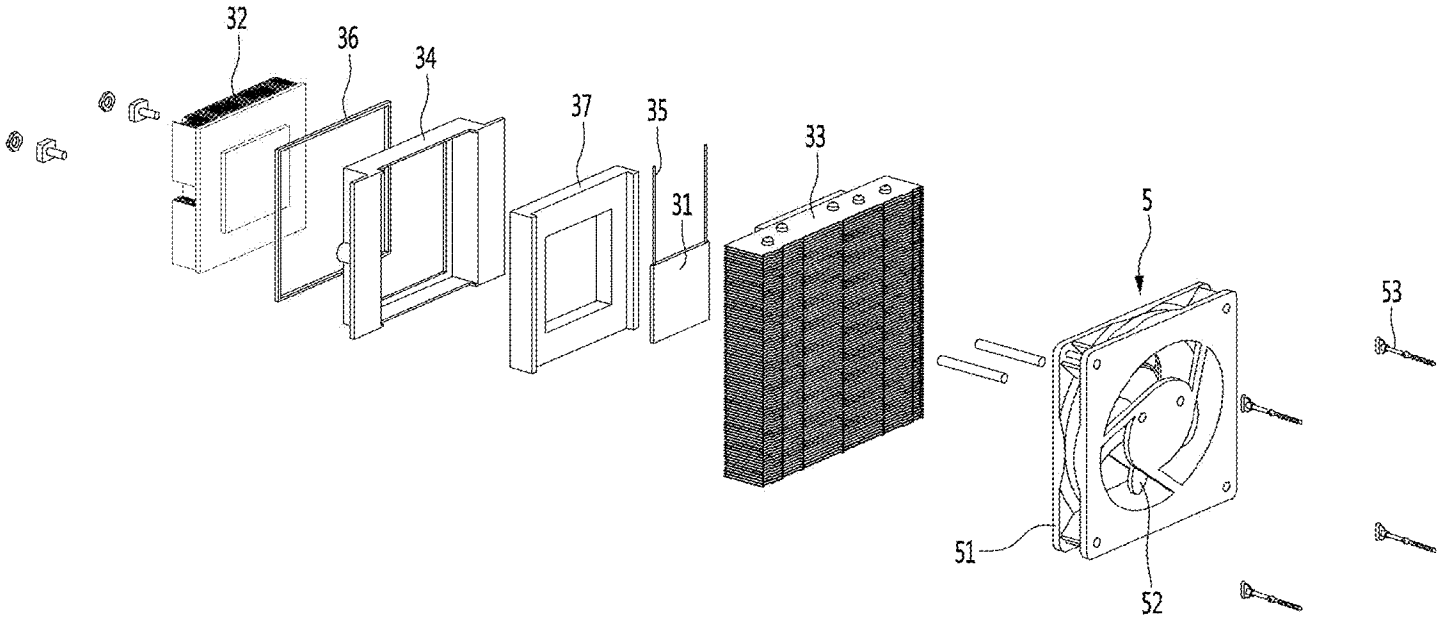
FIG. 7 is an exploded perspective view of the thermoelectric module and the heat dissipation fan shown in FIG. 5 when they are seen in another direction.
Figure 8:
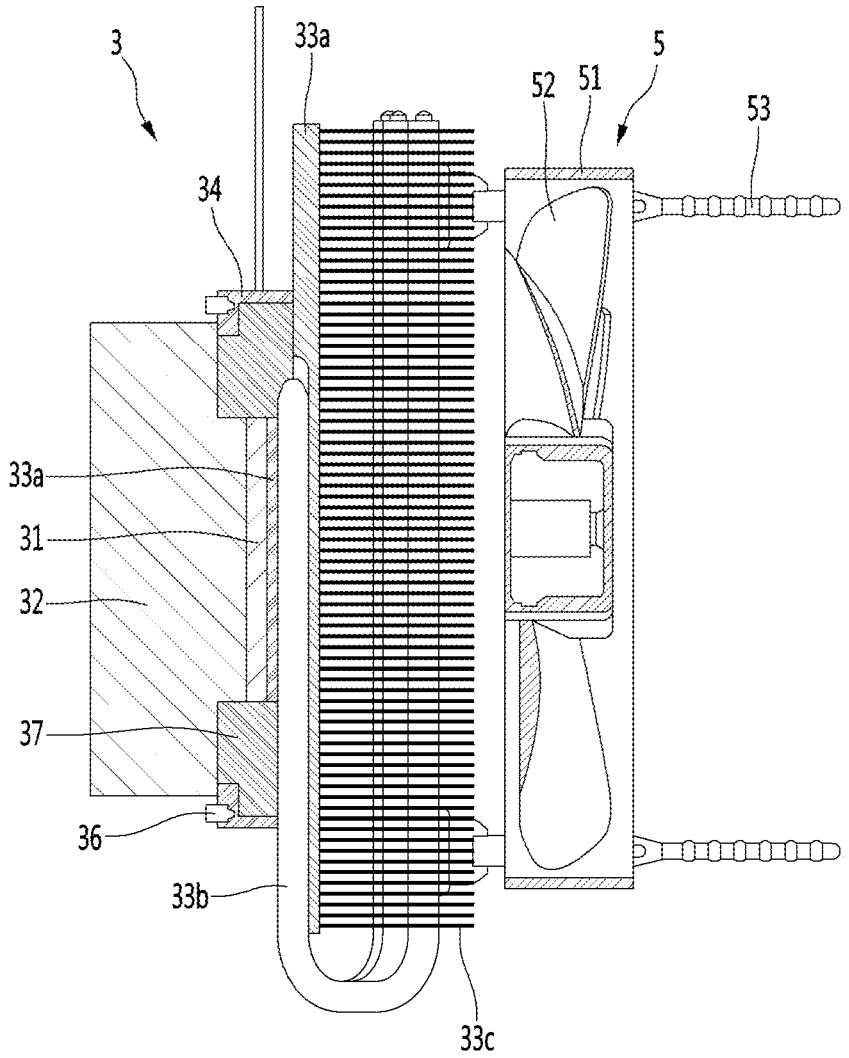
FIG. 8 is a cross-sectional view showing the thermoelectric module and the heat dissipation fan according to an embodiment of the present invention.
Figure 9:
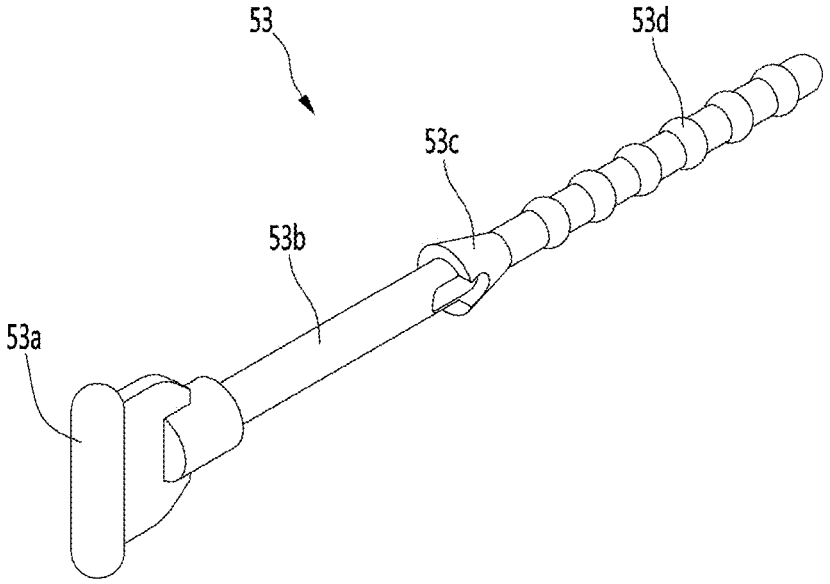
FIG. 9 is a perspective view of a fixing pin according to an embodiment of the present invention.
Figure 10:
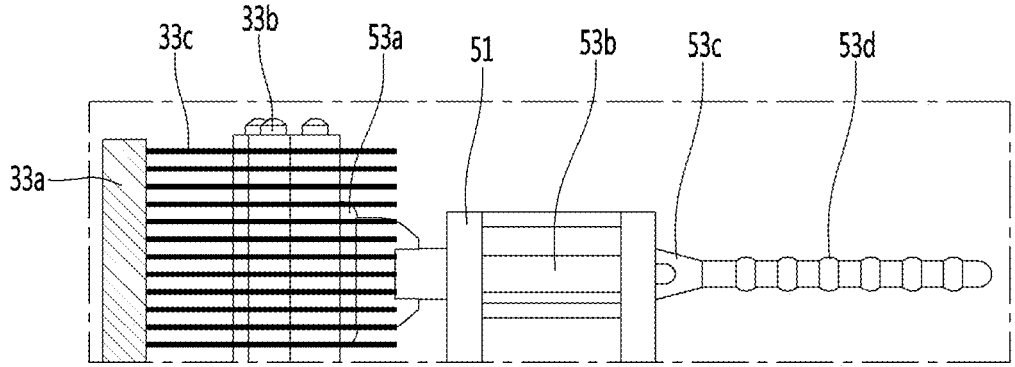
FIG. 10 is a side view for describing a configuration in which the thermoelectric module and the heat dissipation fan are fixed by the fixing pin.
Figure 11:
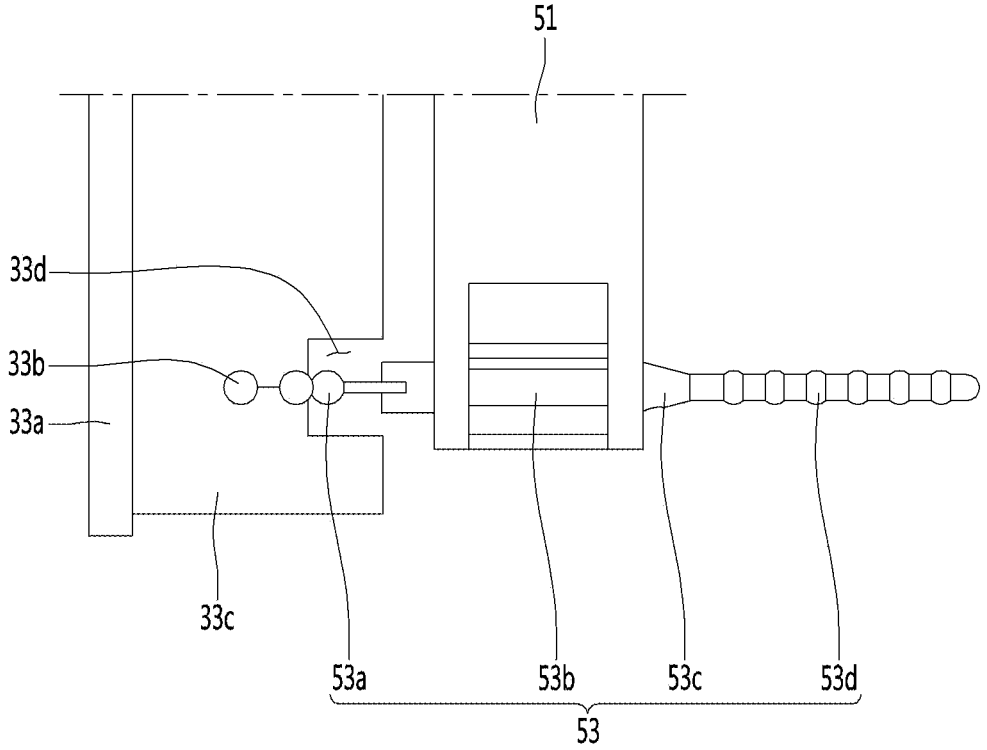
FIG. 11 is a plan view for describing the configuration in which the thermoelectric module and the heat dissipation fan are fixed by the fixing pin.
Figure 12:
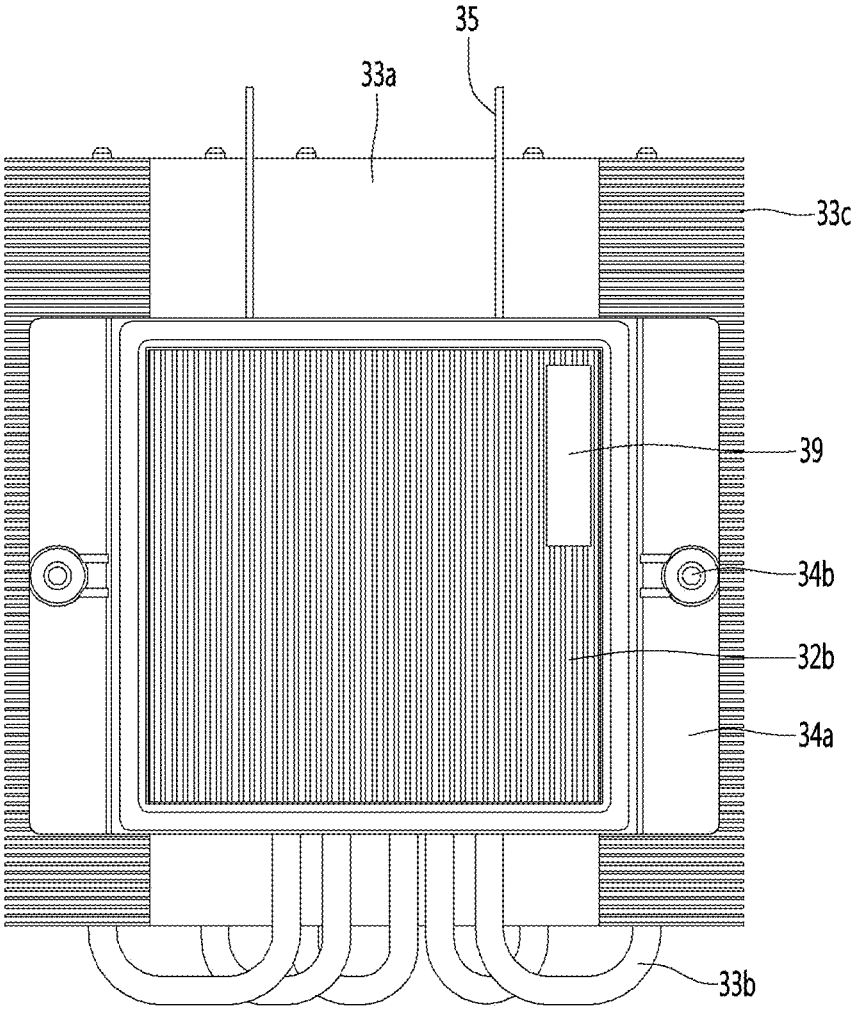
FIG. 12 is a front view of the thermoelectric module according to an embodiment of the present invention.
Figure 13:
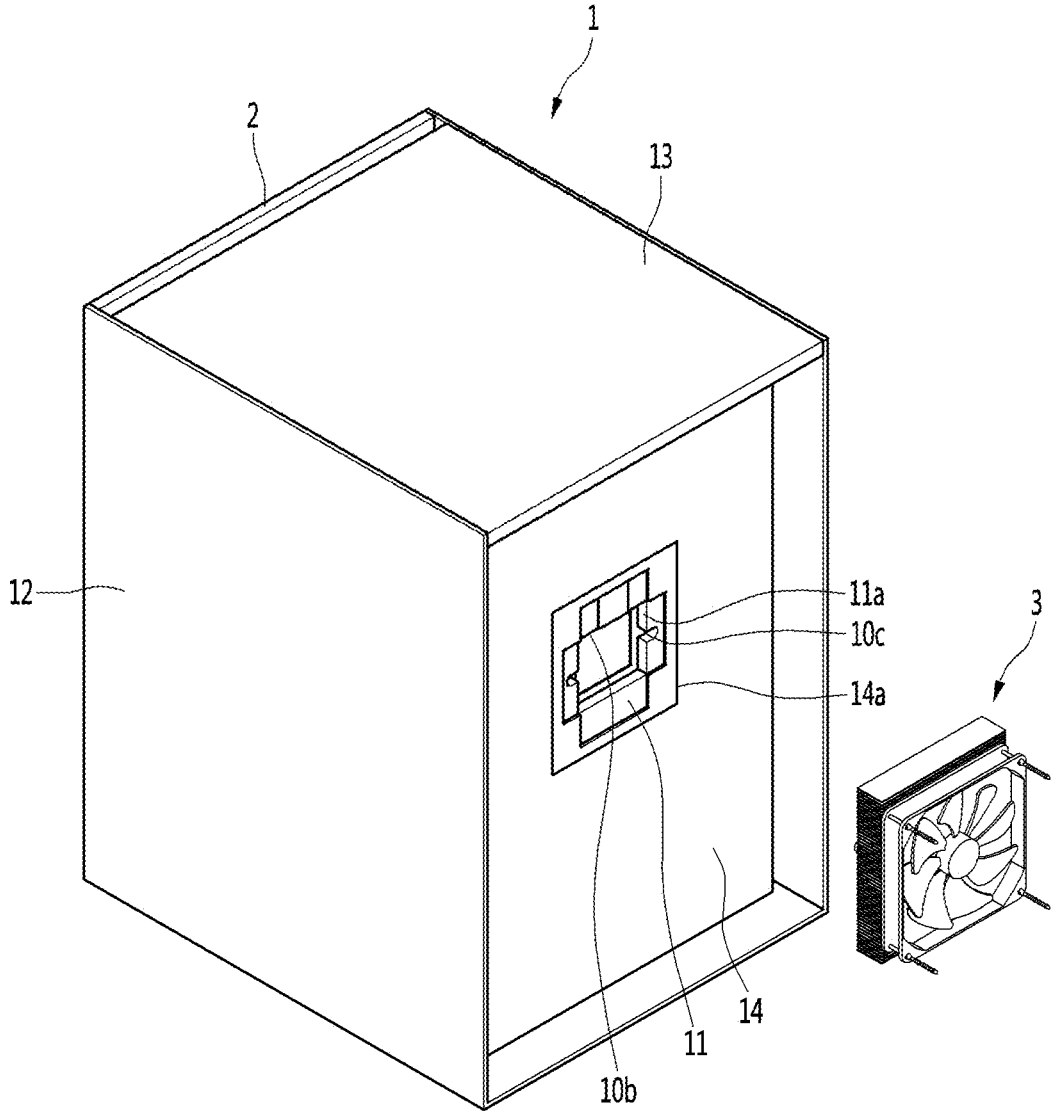
FIG. 13 is a view for describing a configuration in which the thermoelectric module according to an embodiment of the present invention is mounted on a thermoelectric module holder.
Figure 14:
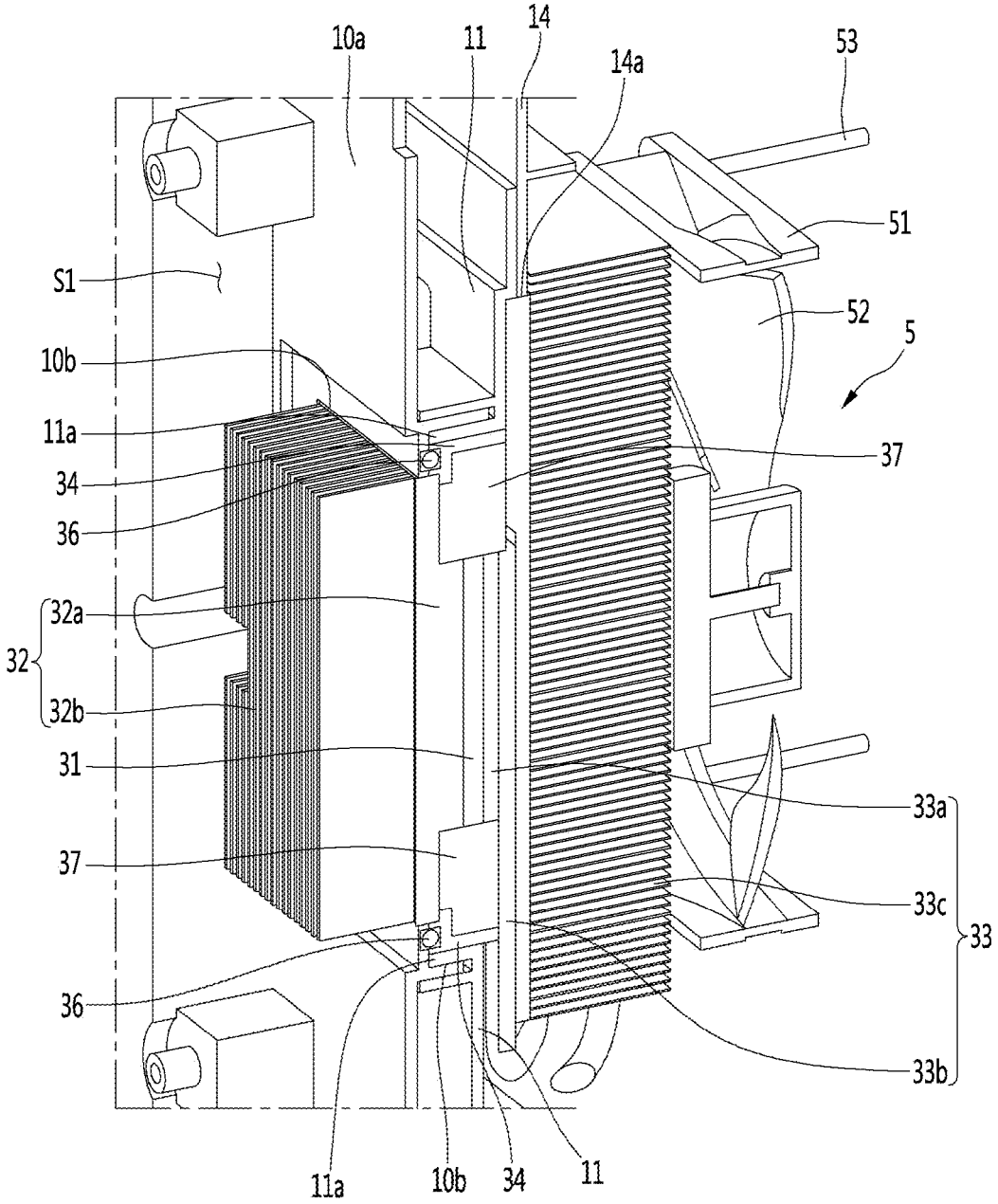
FIG. 14 is a cut perspective view when the thermoelectric module according to an embodiment of the present invention is mounted on an inner case and the thermoelectric module holder.

FIG. 5 is a perspective view showing a thermoelectric module and a heat dissipation fan according to an embodiment of the present invention, FIG. 6 is an exploded perspective view of the thermoelectric module and the heat dissipation fan shown in FIG. 5, FIG. 7 is an exploded perspective view of the thermoelectric module and the heat dissipation fan shown in FIG. 5 when they are seen in another direction, FIG. 8 is a cross-sectional view showing the thermoelectric module and the heat dissipation fan according to an embodiment of the present invention, FIG. 9 is a perspective view of a fixing pin according to an embodiment of the present invention, FIG. 10 is a side view for describing a configuration in which the thermoelectric module and the heat dissipation fan are fixed by the fixing pin, FIG. 11 is a plan view for describing the configuration in which the thermoelectric module and the heat dissipation fan are fixed by the fixing pin, FIG. 12 is a front view of the thermoelectric module according to an embodiment of the present invention, FIG. 13 is a view for describing a configuration in which the thermoelectric module according to an embodiment of the present invention is mounted on a thermoelectric module holder, and FIG. 14 is a cut perspective view when the thermoelectric module according to an embodiment of the present invention is mounted on an inner case and the thermoelectric module holder.

Hereafter, the detailed configuration of the thermoelectric module 3 and the heat dissipation fan 5 is described with reference to FIGS. 5 to 14.

The thermoelectric module 3 can keep the temperature of the storage chamber S low using Peltier effect. The thermoelectric module 3 includes the thermoelectric element 31, the cooling sink 32, and the heat sink 33.

The thermoelectric element 31 may be disposed between the cooling sink 32 and the heat sink 33 and may be in contact with the cooling sink 32 and the heat sink 33. The low-temperature portion of the thermoelectric element 31 may be in contact with the cooling sink 32 and the high-temperature portion of the thermoelectric element 31 may be in contact with the heat sink 33.

The thermoelectric element 31 may have a fuse, and when an excessive voltage is applied to the thermoelectric element, the fuse 35 can block the voltage that is applied to the thermoelectric element 31.

The cooling sink 32 may be a cooling heat exchanger connected to the low-temperature portion of the thermoelectric element 31 and can cool the storage chamber S. Further, the heat sink 33 may be a heating heat exchanger connected to the high-temperature portion of the thermoelectric element 31 and can dissipate heat suctioned by the cooling sink 32.

The thermoelectric module 3 may be disposed forward further than the heat dissipation cover 3. The cooling sink 32 may be disposed closer to the inner case 10 than the heat sink 33. The cooling sink 32 may be disposed ahead of the thermoelectric element 31. The cooling sink 32 may be maintained at low temperature in contact with the low-temperature portion of the thermoelectric element 31.

Further, the heat sink 33 may be disposed closer to the heat dissipation cover 8 to be described below than the cooling sink 32. The heat sink 33 may be maintained at high temperature in contact with the high-temperature portion of the thermoelectric element 31. The heat sink 33 may be positioned under the controller 18*a* to be described below.

The thermoelectric module 3 may be disposed such that one of the thermoelectric element 31, the cooling sink 32, and the heat sink 33 passes through the through-hole 14*a*. The thermoelectric module 3 can be disposed such that the heat sink 33 passes through the through-hole 14*a*. In this case, the thermoelectric element 31 and the cooling sink 32 may be positioned ahead of the through-hole 14*a* and the heat sink 33 may be positioned behind the through-hole 14*a*.

The cooling sink 32 may include a cooling plate 32*a* and a cooling fin 32*b*.

The cooling plate 32*a* may be disposed in contact with the thermoelectric element 31. A portion of the cooling plate 32*a* may be inserted in a heating element accommodation hole formed in the insulating member 37 and may be in contact with the thermoelectric element 31. The cooling plate 32*a* may be positioned between the cooling fin 32*b* and the thermoelectric element 31. The cooling plate 32*a* is in contact the low-temperature portion of the thermoelectric element 31, thereby being able to transmit heat of the cooling fin 32*b* to the low-temperature portion of the thermoelectric element 31.

The cooling plate 32*a* may be made of a material having high thermal conductivity. The cooling plate 32*a* may be positioned in the thermoelectric module seat hole 10*b* of the inner case 10. The cooling plate 32*a* may be formed in a size that blocks the thermoelectric module seat hole 10*b* of the inner case 10.

The cooling fin 32*b* may be disposed in contact with the cooling plate 32*a*. The cooling fin 32*b* may protrude from a surface of the cooling plate 32*a*.

The cooling fin 32*b* may be positioned ahead of the cooling plate 32*a*. At least some of the cooling fin 32*b* may be positioned in the cooling channel S1 in the thermoelectric module seat 10*a* and can cool air by exchanging heat with the air in the cooling channel S1.

The cooling fin 32*b* may include a plurality of fins to increase the area exchanging heat with air. The cooling fin 32*b* may be formed to vertically guide air. The plurality of fins constituting the cooling fin 32*b* each may be configured as a vertical plate having a left side and a right side and vertically elongated.

The cooling fin 32*b* may be disposed to be positioned between the fan 42 of the cooling fan 4 and the thermoelectric element 31 and can guide the air blown from the fan 42 of the cooling fan 4 to the upper discharge hole 45 and the lower discharge hole 46. The air blown from the fan 42 of the cooling fan 4 can be guided to the cooling fin 32*b* and distributed up and down.

The heat sink 33 may include a heat dissipation plate 33*a*, a heat dissipation pipe 33*b*, and a heat dissipation fin 33*c*.

The heat dissipation plate 33*a* may be disposed in contact with the thermoelectric element 31. A portion of the heat dissipation plate 33*a* may be inserted in an element seat hole formed in the insulating member 37 and may be in contact with the thermoelectric element 31. The heat dissipation plate 33*a* is in contact with the high-temperature portion of the thermoelectric element 31, thereby being able to conduct heat to the heat dissipation pipe 33*b* and the heat dissipation fin 33*c*.

The heat dissipation plate 33*a* may be made of a material having high thermal conductivity.

At least one of the heat dissipation plate 33*a* and the heat dissipation fin 33*c* may be disposed in the through-hole 14*a* of the back plate 14.

The heat dissipation pipe 33*b* may be a heat pipe filled with heating fluid. A portion of the heat dissipation pipe 33*b* may be disposed through the heat dissipation plate 33*a* and the other portion may be disposed through the heat dissipation fin 33*c*.

The heating fluid in the heat dissipation pipe 33*b* may vaporize at the portion of the heat dissipation pipe 33*b* that passes through the heat dissipation plate 33*a* and the heating fluid may condense at the portion being in contact with the heat dissipation fin 33*c*. The heating fluid can conduct heat of the heat dissipation plate 33*a* to the heat dissipation fin 33*c* while circulating through the heat dissipation pipe 33*b* by a density difference and/or gravity.

The heat dissipation fin 33*c* can be in contact with at least one of the heat dissipation plate 33*a* and the heat dissipation pipe 33*b*, and may be spaced apart from the dissipation plate 33*a*, but connected to the dissipation plate 33*a* through the dissipation pipe 33*b*. When the heat dissipation fin 33*a* is disposed in contact with the heat dissipation plate 33*a*, the heat dissipation pipe 33*b* may be omitted.

The heat dissipation fin 33*c* may include a plurality of fins disposed perpendicular to the heat dissipation pipe 33*b*.

The heat dissipation fin 33*c* can guide the air blown by the heat dissipation fan 5 and the air guide direction of the heat dissipation fin 33*c* may be different from the air guide direction of the cooling fin 32*b*. For example, when the cooling fin 32*b* guides air up and down, the heat dissipation fin 33*c* may guide air left and right.

The heat dissipation fin 33*c* may be formed to guide air horizontally (particularly, in the left-right direction of the up-down direction and the left-right direction), and it is preferable that the plurality of fins constituting the heat dissipation fin 33*c* each have a top surface and a bottom surface and are horizontally elongated.

When the heat dissipation fin 33*c* is vertically elongated, the air guided to the heat dissipation fin 33*c* may flow much toward the controller 18*a*. On the contrary, when the heat dissipation fin 33*c* is horizontally elongated, the air guided to the heat dissipation fin 33*c* and flowing toward the controller 18*a* may be minimized.

The heat dissipation plate 33*a* may be positioned between the heat dissipation fin 33*c* and the thermoelectric element 31 and the heat dissipation fin 33*c* may be positioned behind the heat dissipation plate 33*a*.

The heat dissipation fin 33*c* may be positioned behind the back plate 14. The heat dissipation fin 33*c* may be positioned between the back plate 14 and the heat dissipation cover 8 and may discharge heat by exchanging heat with external air suctioned by the heat dissipation fan 5.

The thermoelectric module 3 may further include the module frame 34 and the insulating member 37.

The module frame 34 may have a box shape. The module frame 34 may have a space formed therein in which the insulating member 37 and the thermoelectric element 31 are accommodated. The module frame 34 and the insulating member 37 can protect the thermoelectric element 31.

The module frame 34 may be made of a material that can minimize a loss of heat due to thermal conduction. For example, the module frame 34 may have a non-metallic material such as plastic. The module frame 34 can prevent the heat of the heat sink 33 from being conducted to the cooling sink 32.

A gasket 36 may be disposed on the front surface of the module frame 34. The gasket 36 may have an elastic material such as rubber. The gasket 36 may be formed in a rectangular ring shape but is not limited thereto. The gasket 36 may be a sealing member.

The gasket 36 may be disposed on the rear surface of the thermoelectric module seat 10*a* and/for around the thermoelectric module seat hole 10*b*. The gasket 36 may be disposed between the module frame 34 and the thermoelectric module seat 10*a* and pressed in the front-rear direction.

The gasket 36 can prevent the cold air in the cooling channel S1 in the thermoelectric module seat 10*a* from leaking out through the gap between the thermoelectric module seat hole 10*b* and the cooling sink 32.

The module frame 34 may have a fastening portion 34*a*. The fastening portion 34*a* may extend outward from at least a portion of the circumference of the module frame 34. The fastening portion 34*a* may extend outward from the left side and the right side of the circumference of the module frame 34.

The fastening portion 34*a* may include a boss 34*b*. A thread may be formed inside the boss 34*b* and a fastener such as a bolt can be fastened therein. The fastener may be fastened, in the inner case 10, to the fastening portion 34*a* of the module frame 34 through the fastening hole 10*c* formed in the inner case 10, and in more detail, may be coupled to the boss 34*b* of the fastening portion 34*a*. Accordingly, the thermoelectric module 3 and the inner case 10 can be firmly fastened and leakage of the cold air in the inner case 10 can be prevented.

The insulating member 37 may be disposed to surround the outer circumference of the thermoelectric element 31. The insulating member 37 may be disposed to surround the top surface, the left side, the bottom surface, and the right side of the thermoelectric element 31. The thermoelectric element 31 may be positioned in the insulating member 37. A thermoelectric element accommodation hole that is open in the front-rear direction may be formed in the insulating member 37 and the thermoelectric element 31 may be positioned in the thermoelectric element accommodation hole.

The front-rear directional thickness of the insulating member 37 may be larger than the thickness of the thermoelectric element 31.

The insulating member 37 can increase the efficiency of the thermoelectric element 31 by preventing heat of the thermoelectric element 31 from being conducted to the circumference of the thermoelectric element 31. That is, the circumference of the thermoelectric element 31 may be surrounded by the insulating member 37, thereby being able to minimize transfer of the heat, which is generated from the heat sink 33, to the cooling sink 32.

The insulating member 37 may be disposed in the module frame 34 together with the thermoelectric element 31 and can be protected by the module frame 34. The module frame 34 may be disposed to surround the outer circumference of the insulating member 37.

The refrigerator may further include a thermoelectric module holder 11 fixing the thermoelectric module 3 to the inner case 10 and/or the back plate 14.

The thermoelectric module holder 11 can couple the thermoelectric module 3 to the inner case 10 and/or the back plate 14.

The thermoelectric module holder 11 may be coupled to the thermoelectric module seat 10*a* of the inner case 10 and/or the back plate 14 by a fastener (not shown) such as a screw.

The thermoelectric module holder 11 can block the through-hole 14*a* of the back plate 14 in cooperation with the thermoelectric module 3.

The thermoelectric module seat 10*a* may have a center hole 11*a*. The center hole 11*a* may be formed by extending and protruding forward a portion of the thermoelectric module holder 11.

The module frame 34 may be inserted in the center hole 11*a* and the center hole 11*a* may surround the circumference of the module frame 34.

The front portion of the thermoelectric module 3 may be positioned ahead of the through-hole 14*a* of the back plate 14 and the rear portion of the thermoelectric module 3 may be positioned behind the through-hole 14*a* of the back plate 14.

The thermoelectric module 3 may further include a sensor 39. The sensor 39 may be disposed in the cooling sink 32. The sensor 39 may be a temperature sensor or a defrosting sensor.

Meanwhile, the heat dissipation fan 5 may be disposed behind the thermoelectric module 3. The heat dissipation fan 5 may be disposed behind the heat sink 33 to face the heat sink 33 and can blow external air to the heat sink 33.

The heat dissipation fan 5 may be disposed to face the external air intake hole 8*a*.

The heat dissipating fan 5 may include a fan 52 and a shroud 51 surrounding the outer side of the fan 52. The fan 52 of the heat dissipation fan 5 may be an axial fan.

The heat dissipation fan 5 may be disposed to be spaced apart from the heat sink 33. Accordingly, the flow resistance of the air blown by the heat dissipation fan 5 can be minimized and heat exchange efficiency at the heat sink 33 can be increased.

The heat dissipation fan 5 may have at least one fixing pin 53. The fixing pin 53 can be in contact with the heat sink 33 and can fix the heat dissipation fan 5 to the heat sink 33 while spacing the heat dissipation fan 5 from the heat sink 33.

The fixing pin 53 may be made of a material having low thermal conductivity such as rubber or silicon.

The fixing pin 53 may have a head portion 53*a*, a body portion 53*b*, a fixing portion 53*c*, and an extending portion 53*d*.

The head portion 53*a* may be in contact with the heat sink 33. In more detail, the head portion 53*a* may be in contact with the heat dissipation pipe 33*b* and/or the heat dissipation fin 33*c* of the heat sink 33.

A groove 33*d* may be formed at the portion where the hat pipe 33*b* passes through the heat dissipation fin 33*c*. The groove 33*d* formed at the heat dissipation fin 33*c* may be elongated in the up-down direction.

The head portion 53*a* of the fixing pin 53 may be inserted in the groove 33*d* of the heat dissipation fin 33*c*.

The head portion 53*a* may be larger in diameter than the body portion 53*b*.

The body portion 53*b* may be disposed at the heat dissipation fan 5. In more detail, the body portion 53*b* may be disposed in a fixing pin-through hole formed at the shroud 53.

The front-rear directional length of the body portion 53*b* may be the same as the front-rear directional thickness of the heat dissipation fan 5. The body portion 53*b* may be positioned between the head portion 53*a* and the fixing portion 53*c*.

The fixing portion 53*c* may be larger in diameter than the body portion 53*b*. The fixing portion 53*c* may be fixed after passing through the shroud 51 of the heat dissipation fan 5. The fixing portion 53*c* may be fixed in contact with the rear surface of the shroud 51.

The extending portion 53*d* may extend rearward from the fixing portion 53*c*. The diameter of the extending portion 53*d* may be smaller than or the same as the diameter of the fixing portion 53*c*. A thread, etc. may be formed on the outer circumference of the extending portion 53*d*.

The extending portion 53*d* may be coupled to the heat dissipation cover 8 or may pass through the heat dissipation cover 8.

The heat dissipation fan 5 can suction external air through the external air intake hole 8*a* formed in the heat dissipation cover 8. The air suctioned by the heat dissipation fan 5 can dissipate heat of the heat sink 33 while exchanging heat with the heat sink 33 positioned between the back plate 14 and the heat dissipation cover 8.

Figure 15:
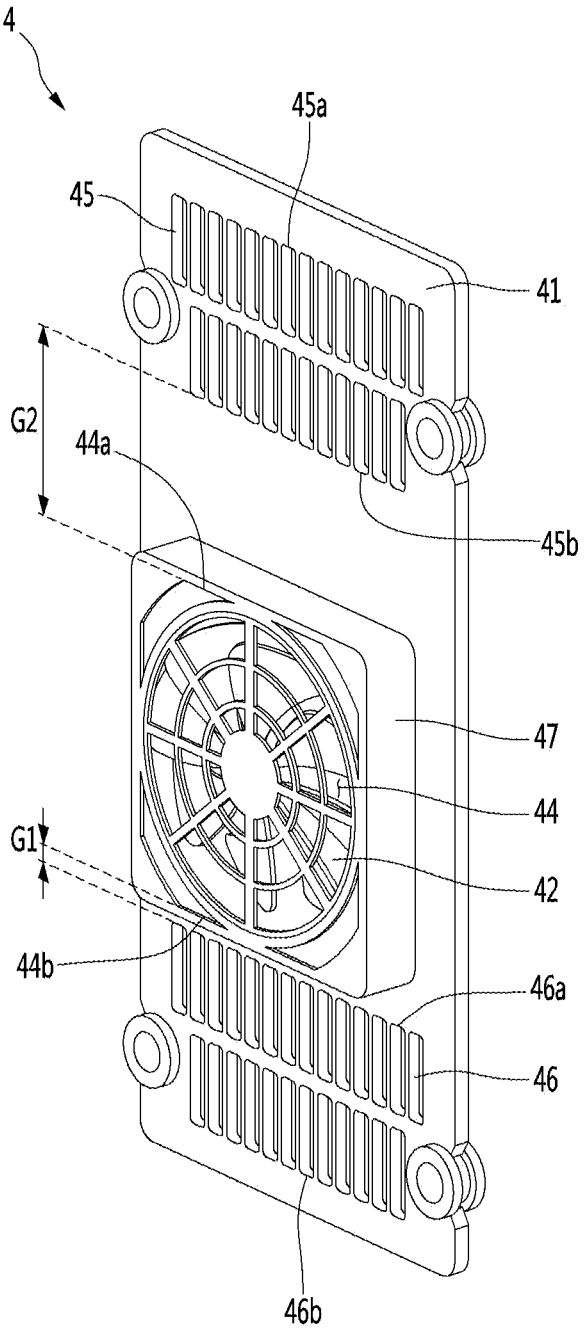
FIG. 15 is a perspective view showing a cooling fan according to an embodiment of the present invention.

FIG. 15 is a perspective view showing a cooling fan according to an embodiment of the present invention.

Hereafter, the cooling fan 4 is described in detail with reference to FIG. 14.

The cooling fan 4 may be disposed ahead of the thermoelectric module 3 and may be disposed to face the cooling sink 32.

The cooling fan 4 can circulate air to the cooling channel S1 and the storage chamber S. Forcible conduction can be generated between the cooling channel S1 and the storage chamber S by the cooling fan 4. The cooling fan 4 can send air in the storage chamber S to the cooling channel S1 and low-temperature air that has exchanged heat with the cooling sink 32 disposed in the cooling channel 1 can keep the temperature of the storage chamber S low by flowing back into the storage chamber S.

The cooling fan 4 may include a fan cover 41 and a fan 42.

The fan cover 41 may be disposed inside the inner case 10. The fan cover 41 may be vertically disposed. The fan cover 41 may divide the storage chamber S and the cooling channel S1. The storage chamber S may be positioned ahead of the fan cover 41 and the cooling channel S1 may be positioned behind the fan cover 41.

An inner suction hole 44 and inner discharge holes 45 and 46 may be formed at the fan cover 41.

The numbers, sizes, and shapes of the inner suction hole 44 and the inner discharge holes 45 and 46 may be changed, if necessary.

The inner discharge holes 45 and 46 may include an upper discharge hole 45 and a lower discharge hole 46. The upper discharge hole 45 may be formed higher than the inner suction hole 44 and the lower discharge hole 46 may be formed lower than the inner suction hole 44. This configuration has the advantage that the temperature distribution in the storage chamber S can be made uniform.

The area of the upper discharge hole 45 and the area of the lower discharge hole 46 may be the same as each other.

The distance G1 between an upper end 46*a* of the lower discharge hole 46 and a lower end 44*b* of the inner suction hole 44 may be smaller than the distance G2 between a lower end 45*d* of the upper discharge hole 45 and an upper end 44*a* of the inner suction hole 44. That is, inner suction hole 44 may be formed at a position closer to the lower discharge hole 46 than the upper discharge hole 45.

Table 1 shows test values obtained by measuring temperature at receiving members according to the area ratio of the inner suction hole 44, and the upper discharge hole 45 and the lower discharge hole 46.

TABLE 1

| | Area ratio of inner suction hole 44 and inner discharge holes 45 and 46 | | |
|---|---|---|---|
| | 1:1.74 | 1:1.34 | 1:0.94 |
| Internal temperature of first receiving member 6 | 10.0° C. | 10.1° C. | 10.9° C. |
| Internal temperature of second receiving member 7 | 9.4° C. | 9.5° C. | 10.0° C. |
| Average internal temperature of receiving members 6 and 7 | 9.7° C. | 9.8° C. | 10.4° C. |

The area of the inner suction hole 44 may depend on the size of the fan 41 and the areas of the inner discharge holes 45 and 46 may have a predetermined ratio to the area of the inner suction hole 44.

Referring to Table 1, the average internal temperature of the receiving members 6 and 7 is higher by 0.1° C. when the area ratio of the inner suction hole 44 and the inner discharge holes 45 and 46 is 1:1.34 than when it is 1:1.74. That is, when the area ratio of the inner suction hole 44 and the inner discharge holes 45 and 46 is larger than 1:1.34, there is no large difference in inner temperature between the receiving members 6 and 7, so the refrigeration performance of the refrigerator is relatively constant.

However, the average internal temperature of the receiving members 6 and 7 is higher by 0.7° C. when the area ratio of the inner suction hole 44 and the inner discharge holes 45 and 46 is 1:0.94 than when it is 1:1.34. That is, when the area ratio of the inner suction hole 44 and the inner discharge holes 45 and 46 is smaller than 1:1.34, the inner temperature of the receiving members 6 and 7 greatly increases, so the refrigeration performance of the refrigerator is deteriorated.

Accordingly, it is preferable that the area ratio of the inner suction hole 44 and the inner discharge holes 45 and 46 is 1.3 or more. Further, when the area ratio of the inner suction hole 44 and the inner discharge holes 45 and 46 increases, the size of the fan cover is increased, so it is preferable that the area ratio of the inner suction hole 44 and the inner discharge holes 45 and 46 is 1.5 or less for making the fan cover compact.

In more detail, it is preferable that the sum of the areas of the upper discharge hole 45 and the lower discharge hole 46 is 1.3 time or more and 1.5 time or less than the area of the inner suction hole 44.

The fan cover 41 may have a fan accommodation hole 47. The fan accommodation hole 47 may be formed by protruding forward a portion of the front surface of the fan cover 41 and a fan accommodation space may be formed inside the fan accommodation hole 47. At least a portion of the fan 42 may be disposed in the fan accommodation space formed inside the fan accommodation hole 47. The inner suction hole 44 may be formed at the fan accommodation hole 47.

The fan 42 may be disposed in the cooling channel S1 and may be disposed behind the fan cover 41. The fan cover 41 can cover the fan 42 from the front.

The fan 42 may be disposed to face the inner suction hole 44. When the fan 42 is driven, the air in the storage chamber S is suctioned into the cooling channel S1 through the inner suction hole 44 and can be cooled by exchanging heat with the cooling sink 32 of the thermoelectric module 3. The cooled air can be discharged into the storage chamber S through the inner discharge holes 45 and 46, so the temperature of the storage chamber S can be maintained at a low level.

In more detail, some of the air cooled through the cooling sink 32 can be guided upward and discharged into the storage chamber S through the upper discharge hole 45 and the other of the air can be guided downward and discharged into the storage chamber S through the lower discharge hole 46.

Figure 16:
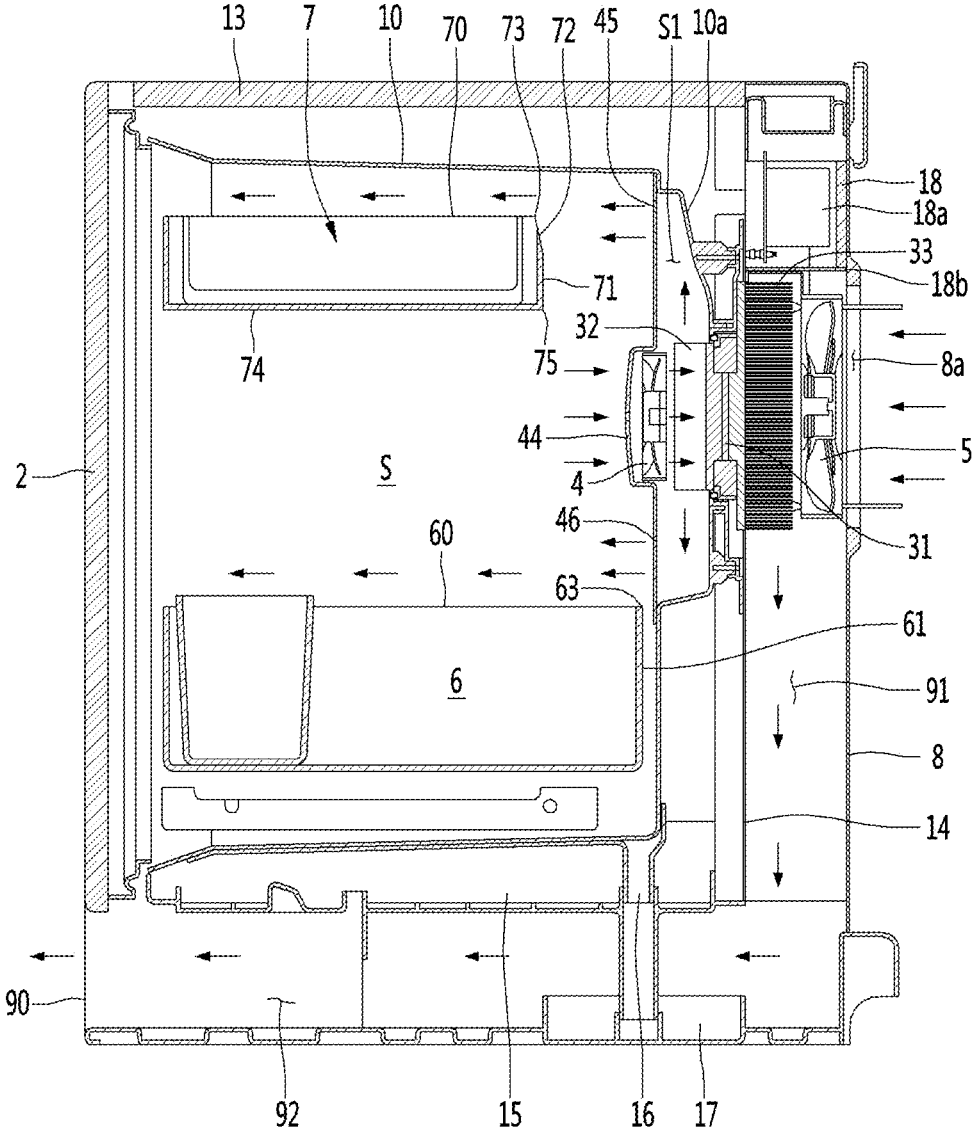
FIG. 16 is a cross-sectional view taken along line A-A of the refrigerator shown in FIG. 1.
Figure 17:
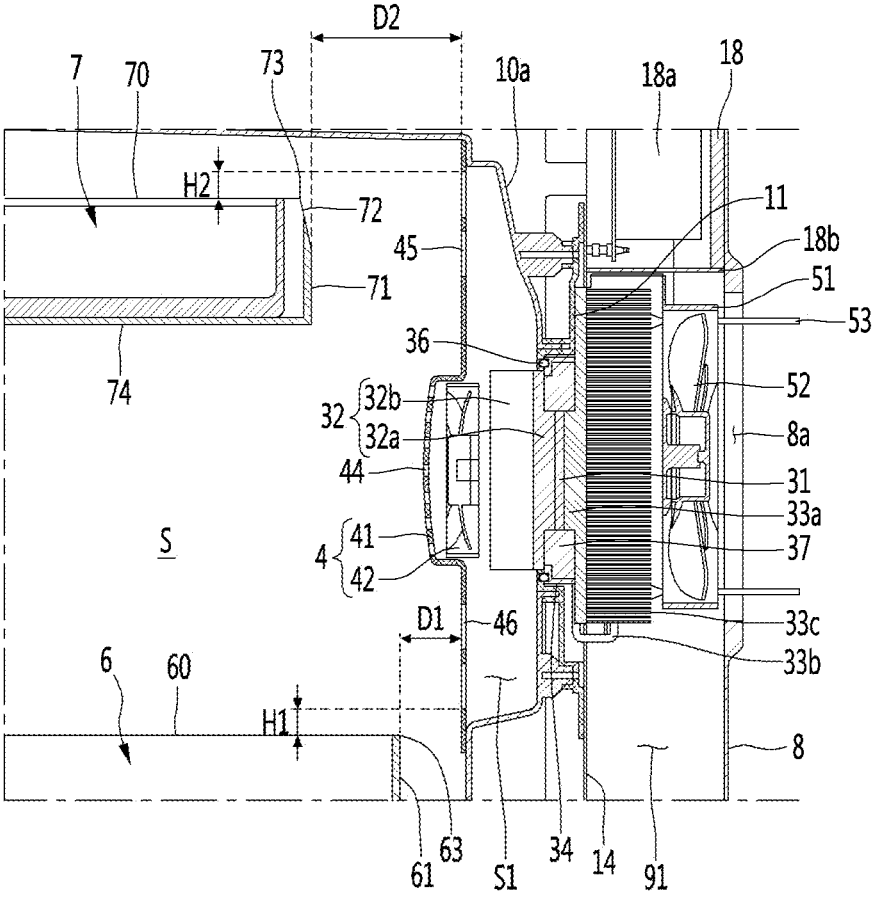
FIG. 17 is a cross-sectional view enlarging the surrounding of the thermoelectric module of the refrigerator shown in FIG. 16.
Figure 18:
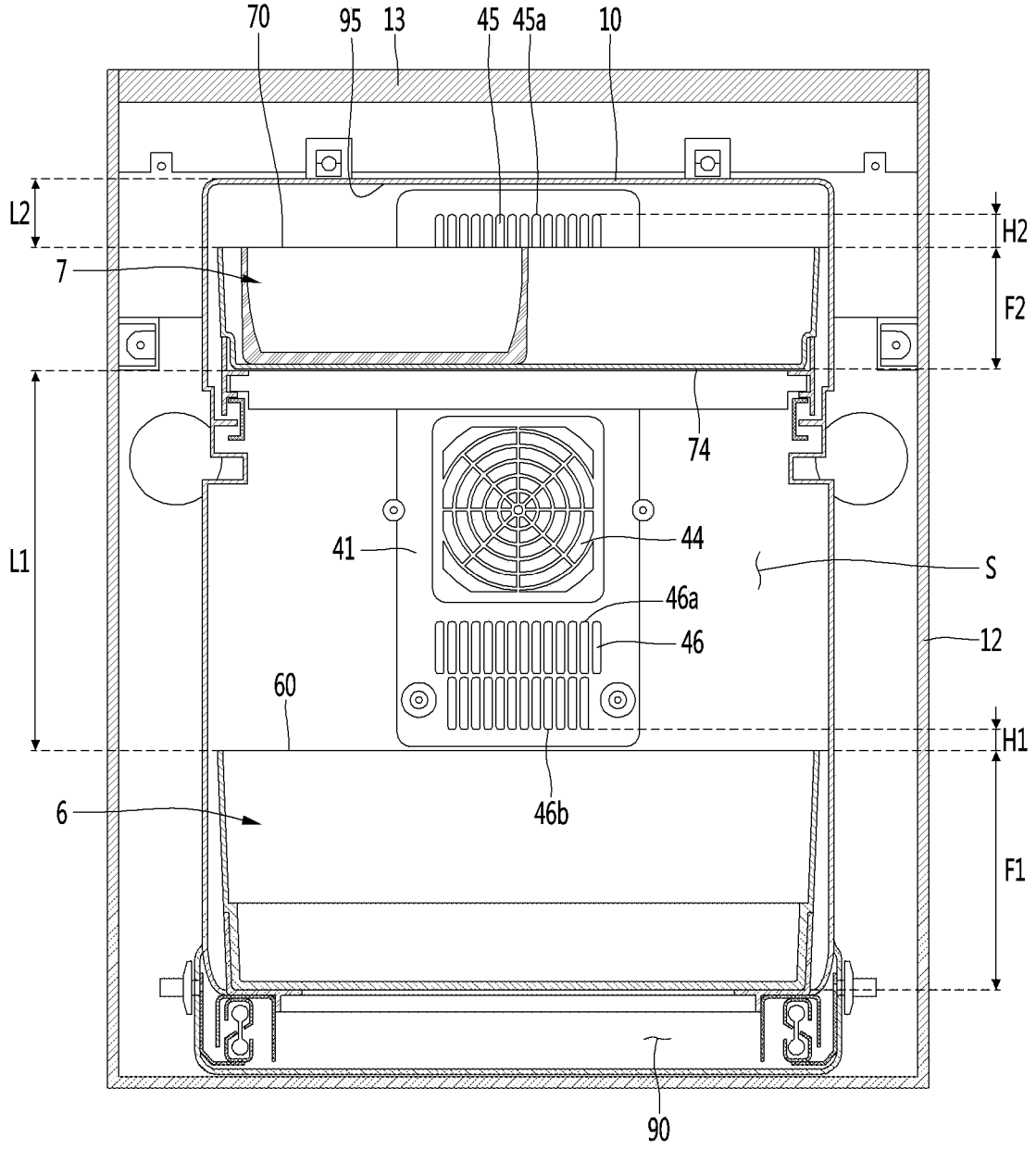
FIG. 18 is a cross-sectional view taken along line B-B of the refrigerator shown in FIG. 1.
Figure 19:
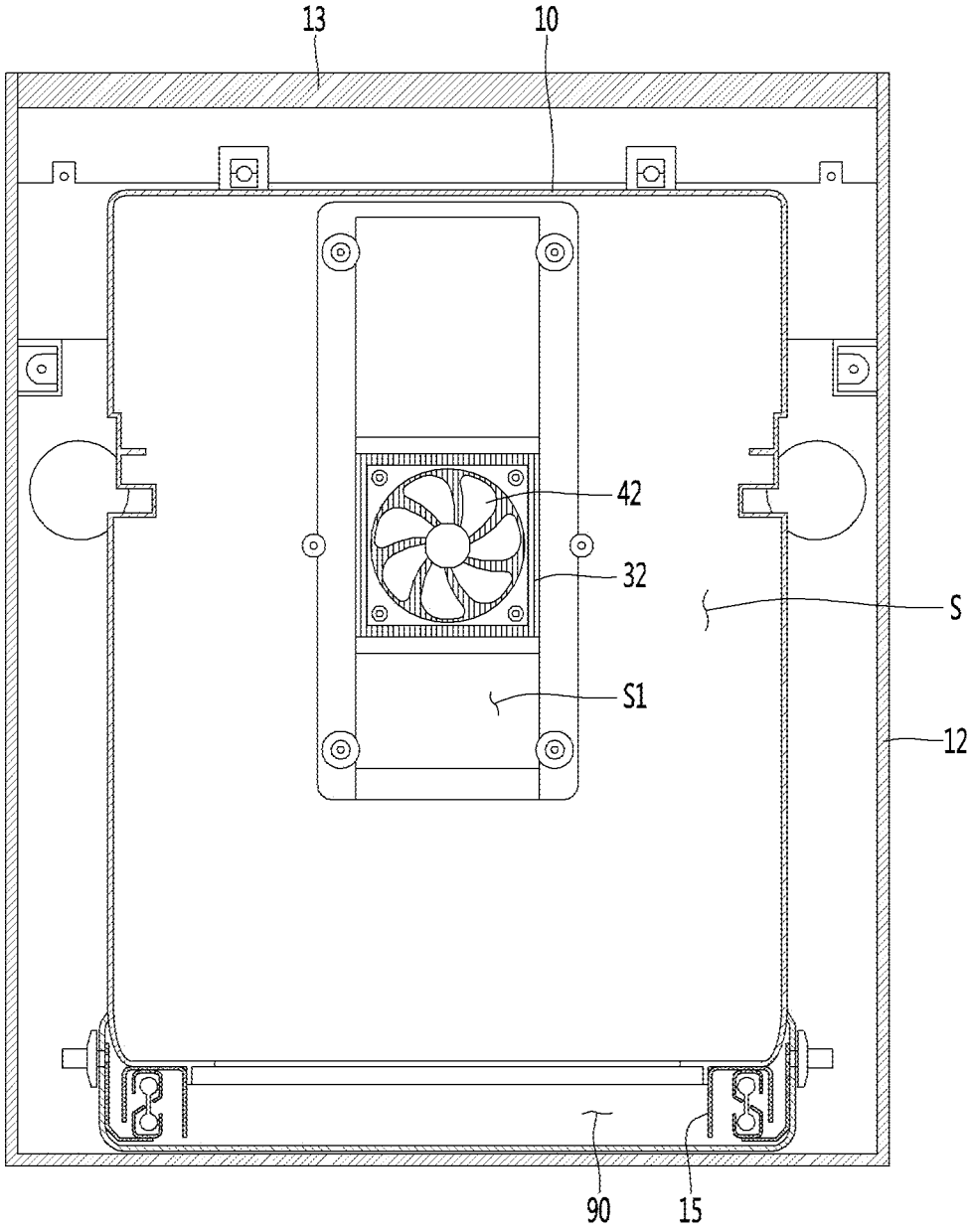
FIG. 19 is a view of the refrigerator shown in FIG. 18 with a receiving member and a fan cover removed.

FIG. 16 is a cross-sectional view taken along line A-A of the refrigerator shown in FIG. 1, FIG. 17 is a cross-sectional view enlarging the surrounding of the thermoelectric module of the refrigerator shown in FIG. 16, FIG. 18 is a cross-sectional view taken along line B-B of the refrigerator shown in FIG. 1, and FIG. 19 is a view of the refrigerator shown in FIG. 18 with a receiving member and a fan cover removed.

Referring to FIGS. 16 to 19, at least a portion of each of the inner suction hole 44 and the lower discharge hole 46 may face the portion between the first receiving member 6 and the second receiving member 7. Further, at least a portion of the upper discharge hole 45 may face the portion between the top surface of the storage chamber S and the second receiving member 7.

The lower end 46*b* of the lower discharge hole 46 may be positioned behind and above the first receiving member 6. In more detail, the lower end 46*b* of the lower discharge hole 46 may be positioned behind and above the upper end 64 of the rear surface of the first receiving member 6.

The rear surface 61 of the first receiving member 6 may be disposed to horizontally face the portion under the lower discharge hole 46 and the lower discharge hole 46 may not horizontally overlap the first receiving member 6. That is, the first receiving member 6 may be disposed not to horizontally cover the lower discharge hole 46.

Accordingly, the flow of the low-temperature air that is discharged to the lower discharge hole 46 is not interfered with by the first receiving member 6, so air can smoothly circulate in the storage chamber S. Further, since low-temperature air moves down, it can maintain the food received in the first receiving member 6 at low temperature.

For smoother air circulation in the storage chamber S, the lower discharge hole 46 and the first receiving member 6 may be disposed to be spaced apart from each other. The lower end 46*b* of the lower discharge hole 46 and the first receiving member 6 may be spaced apart from each other horizontally by a first horizontal spacing distance D1 and vertically by a first vertical spacing distance H1.

In more detail, the first horizontal spacing distance D1 may mean the horizontal distance between an extension line vertically extending upward from the rear surface 61 of the first receiving member 6 and the lower discharge hole 46. The first vertical spacing distance H1 may mean the vertical distance between an extension line extending horizontally forward from the lower end 46*b* of the lower discharge hole 46 and the upper end 60 of the first receiving member 6.

The first horizontal spacing distance D1 may mean the spacing distance between the rear surface of the storage chamber S and the first receiving member. In this configuration, the rear surface of the storage chamber S may be the front surface of the fan cover 41. The first vertical spacing distance H1 may be a height difference between the lower end 46*b* of the lower discharge hole 46 and the upper end 60 of the first receiving member 6.

It is preferable that the first vertical spacing distance H1 between the upper end 60 of the first receiving member 6 and the lower end 46*b* of the lower discharge hole 46 is 10 mm or more. Further, it is preferable that the first horizontal spacing distance D1 between the rear surface 61 and the lower discharge hole 46 is 5 mm or more.

A portion of the upper discharge hole 45 may horizontally overlap the second receiving member 7. In more detail, the upper portion of the upper discharge hole 45 may partially face the portion between the upper end 70 of the second receiving member 7 and the top surface of the storage chamber S, and the lower portion of the upper discharge hole 45 may partially face the rear surface 71 of the second receiving member 7.

The upper end 45*a* of the upper discharge hole 45 may be positioned behind and above the upper end 73 of the rear surface of the second receiving member 7.

Accordingly, there is the advantage in that the height of the storage chamber S can be decreased and the refrigerator can be made compact, as compare with when the upper discharge hole 45 does not horizontally overlap the second receiving member 7.

Further, as described above, in the fan cover 41, the inner suction hole 44 may be formed closer to the lower discharge hole 46 than the upper discharge hole 45. Accordingly, the height of the storage chamber S for satisfying the position relationship of the receiving members 6 and 7, the inner suction hole 45, and the inner discharge holes 45 and 46 can be further decreased.

At least a portion of the rear surface 71 of the second receiving member 7 may be formed to be inclined upward. In the rear surface 71 of the second receiving member 7, the portion facing the upper discharge hole 45 may be a curved surface 72 formed to be inclined upward. The lower portion of the upper discharge hole 45 may partially face the curved surface 72.

The curved surface 72 can guide the low-temperature air, which is discharged to the upper discharge hole 45, over the second receiving member 7. Accordingly, it is possible to maintain the food received in the second receiving member 7 at low temperature.

For smoother air circulation in the storage chamber S, the upper discharge hole 45 and the second receiving member 7 may be disposed to be spaced apart from each other. The lower end 45*a* of the upper discharge hole 45 and the second receiving member 7 may be spaced apart from each other horizontally by a second horizontal spacing distance D2 and vertically by a second vertical spacing distance H2.

In more detail, the second horizontal spacing distance D2 may mean the horizontal distance between the rear surface 71 of the second receiving member 7 and the upper discharge hole 45. The second vertical spacing distance H2 may mean the vertical distance between an extension line extending horizontally forward from the upper end 45*a* of the upper discharge hole 45 and the upper end 70 of the second receiving member 7.

The second horizontal spacing distance D2 may mean the spacing distance between the rear surface of the storage chamber S and the second receiving member 7. In this configuration, the rear surface of the storage chamber S may be the front surface of the fan cover 41. The second vertical spacing distance H2 may be a height difference between the upper end 45*a* of the upper discharge hole 45 and the upper end 70 of the second receiving member 7.

It is preferable that the second vertical spacing distance H2 between the upper end 70 of the second receiving member 7 and the upper end 45*a* of the upper discharge hole 45 is 10 mm or more. Further, it is preferable that the second horizontal spacing distance D2 between the rear surface 71 and the upper discharge hole 45 is 70 mm or more.

The second horizontal spacing distance D2 between the rear surface 71 of the second receiving member 7 and the upper discharge hole 45 may be larger than the first horizontal spacing distance D1 between the rear surface 61 of the first receiving member 6 and the lower discharge hole 46. This is because, unlike the first receiving member 6, the second receiving member 7 horizontally faces a portion of the upper discharge hole 45, so there is a need for an additional distance for air circulation in the storage chamber S. Accordingly, the front-rear directional length of the first receiving member 6 may be larger than the front-rear directional length of the second receiving member 7.

Table 2 shows temperature of receiving members according to the horizontal spacing distance between the inner suction hole and the receiving members.

TABLE 2

| Position relationship between inner suction hole 44 and receiving members 6 and 7 | Disposed not to horizontally face each other | Disposed to horizontally face each other: Horizontally spaced 30 mm | Horizontally spaced 20 mm | Horizontally spaced 10 mm |
|---|---|---|---|---|
| Average temperature of storage chamber S | 9.7° C. | 10.0° C. | 10.3° C. | 12.1° C. |

Referring to Table 2, it can be seen that the average temperature of the storage chamber S increases when the inner suction hole 44 and receiving members 6 and 7 face each other with respect to when the inner suction hole 44 and the receiving members 6 and 7 do not horizontally face each other.

Accordingly, it is preferable that the inner suction hole 44 and the receiving members 6 and 7 do not horizontally face each other. The inner suction hole 44 may face the portion between the first receiving member 6 and the second receiving member 7. That is, the inner suction hole 44 may not horizontally overlap the second receiving member 7. Accordingly, air actively flows to the inner suction hole 44 and the temperature of the storage chamber S drops, so the refrigeration performance of the refrigerator can be improved.

In order to satisfy the position relationship between the inner suction hole 44 and the second receiving member 7 and decrease the height of the storage chamber S, the up-down directional height F2 of the second receiving member 7 may be smaller than the up-down directional height F1 of the first receiving member 6. By this configuration, small food such as a bottle can be received in the first receiving member 6 and smaller food can be received in the second receiving member 7.

However, the inner suction hole 44 may be disposed such that at least a portion thereof horizontally faces the receiving members 6 and 7. In this case, a portion of the inner suction hole 44 may horizontally overlap the second receiving member 7.

Referring to Table 2, it can be seen that when the inner suction hole 44 and receiving members 6 and 7 are disposed to horizontally face each other, the smaller the horizontal spacing distance between the inner suction hole 44 and receiving members 6 and 7, the higher the average temperature of the storage chamber S.

When the inner suction hole 44 and the receiving members 6 and 7 do not horizontally face each other, the average temperature of the storage chamber S increases by 0.3° C. when the horizontal spacing distance is 30 mm, the average temperature of the storage chamber S increases by 0.6° C. when the horizontal spacing distance is 20 mm, and the average temperature of the storage chamber S increases by 3.4° C. when the horizontal spacing distance is 10 mm. That is, it can be seen that the increase of the temperature of the storage chamber S is relatively small when the horizontal spacing distance is 20 mm between the inner suction hole 44 and the receiving members 6 and 7, but the temperature of the storage chamber S rapidly increases when the horizontal spacing distance becomes smaller than 20 mm.

Accordingly, when the inner suction hole 44 is disposed such that at least a portion thereof horizontally faces the receiving members 6 and 7, it is preferable that the horizontal spacing distance between the inner suction hole 44 and the receiving members 6 and 7 is 20 mm or more.

The spacing distance L1 between the first receiving member 6 and the second receiving member 7 may be larger than the spacing distance L2 between the top surface 95 of the storage chamber S and the second receiving member 7. In more detail, the spacing distance between the upper end 60 of the first receiving member 6 and the lower end 74 of the second receiving member 7 may be larger than the spacing distance L2 between the top surface 95 of the storage chamber S and the upper end 70 of the second receiving member 7. That is, the second receiving member 7 may be disposed closer to the top surface 95 of the storage chamber S than the first receiving member 6.

On the other hand, the heat dissipation channels 91 and 92 and the cooling channel S1 may be formed in the refrigerator. The cooling sink 32 may be disposed in the cooling channel S1 and the heat sink 33 may be disposed in the heat dissipation channels 91 and 92. The cooling sink 32 may communicate with the storage chamber S and the heat dissipation channels 91 and 92 may communicate with the outside of the main body 1.

The air in the storage chamber S can be guided to the cooling channel S1 by operation of the cooling fan 4 and can be cooled by exchanging heat with the cooling sink 32.

The cooling channel S1 may be positioned inside the inner case 10. In more detail, the cooling channel S1 may be positioned in the thermoelectric module seat 10*a*. The cooling channel S1 may be formed by the rear surface of the fan cover 41 and the inner surface of the thermoelectric module seat 10*a*.

The cooling channel S1 may communicate with the inner suction hole 44 and the inner discharge holes 45 and 46. The cooling sink 32 may be disposed to face the fan 42. The cooling channel S1 can guide the air suctioned into the inner suction hole 44 to the inner discharge holes 45 and 46.

The external air can be guided to the heat dissipation channels 91 and 92 by operation of the heat dissipation fan 5 and can be heated by exchanging heat with the heat sink 33.

The heat dissipation channels 91 and 92 may be positioned outside the inner case 10.

The heat dissipation channels 91 and 92 may include a rear heat dissipation channel 91 positioned behind the inner case 10 and a lower heat dissipation channel 92 positioned under the inner case 10.

The rear heat dissipation channel 91 may be positioned between the back plate 14 and the heat dissipation cover 8. The rear heat dissipation channel 91 may be formed by the rear surface of the back plate 14 and the inner surface of the heat dissipation cover 8.

The heat sink 33 may be disposed in the rear heat dissipation channel 91. The heat sink 33 may be disposed to face the heat dissipation fan 5. At least a portion of the rear heat dissipation channel 91 may be a machine room.

The rear heat dissipation channel 91 may communicate with the external air intake hole 8*a*. The rear heat dissipation channel 91 can guide the air, which has been suctioned into the external air intake hole 8*a* by the heat dissipation fan 5, to the lower heat dissipation channel 92.

The lower heat dissipation channel 92 may be disposed between the cabinet bottom 15 and the outer cabinet 12. The lower heat dissipation channel 92 may communicate with the rear heat dissipation channel 91.

The lower heat dissipation channel 92 can guide the air, which flows from the rear heat dissipation channel 91, to the heat dissipation channel outlet 90 under the door 20.

On the other hand, the controller 18*a* may be positioned over the heat sink 33 and/or the heat dissipation fan 5, and a barrier 18*b* may be provided between the heat sink 33 and/or the heat dissipation fan 5 and the controller 18*a*. That is, the barrier 18*b* may be positioned under the controller 18*a*. The barrier 18*b* can prevent the controller 18*a* from being overheated by the heat discharged from the heat sink 33. Further, the barrier 18*b* can block the air heated by the heat sink 33 and flowing to the controller 18*a*.

The barrier 18*b* may be mounted on the heat dissipation cover 8 and/or the back plate 14. Alternatively, the barrier 18*b* may be mounted on the PCB cover 18 or integrally formed with the PCB cover 18.

Hereafter, the operation of the refrigerator according to an embodiment of the present invention is described.

When a voltage is applied to the thermoelectric module 31, the cold can be conducted to the cooling sink 32 being in contact with a surface of the thermoelectric module 31 and heat can be conducted to the heat sink 33 being in contact with the other surface of the thermoelectric module 31.

When the heat dissipation fan 5 is driven, the air suctioned into the external air intake hole 8*a* of the heat dissipation cover 8 can be guided into the rear heat dissipation channel 91 between the back plate 14 and the heat dissipation cover 8. The air guided into the rear heat dissipation channel 91 exchanges heat with the heat sink 33, thereby being able to dissipate the heat of the heat sink 33. The air heated by exchanging heat with the heat sink 33 can be guided into the lower heat dissipation channel 92 along the rear heat dissipation channel 91. The air guided into the lower heat dissipation channel 92 flows along the lower heat dissipation channel 92 and can be discharged to the heat dissipation channel outlet 90.

When the cooling fan 4 is driven, the air in the storage chamber S can be suctioned into the inner suction hole 44 of the fan cover 41 and can be guided into the cooling channel S1. The air guided into the cooling channel S1 can be cooled by exchanging heat at the cooling sink 32. Some of the air cooled at the cooling sink 32 can be guided upward through the cooling channel S1 and discharged to the upper discharge hole 45 and the other of the air can be guided downward through the cooling channel S1 and discharged to the lower discharge hole 46.

The low-temperature air flowing into the storage chamber S through the upper discharge hole 45 can be guided over the second receiving member 7 by the curved surface 72 formed to be inclined upward on the second receiving member 7 and can maintain the food received in the second receiving member 7 at low temperature.

The low-temperature air flowing into the storage chamber S through the lower discharge hole 46 can flows into the space over the first receiving member 6 and can maintain the food received in the first receiving member 6 at low temperature.

Figure 20:
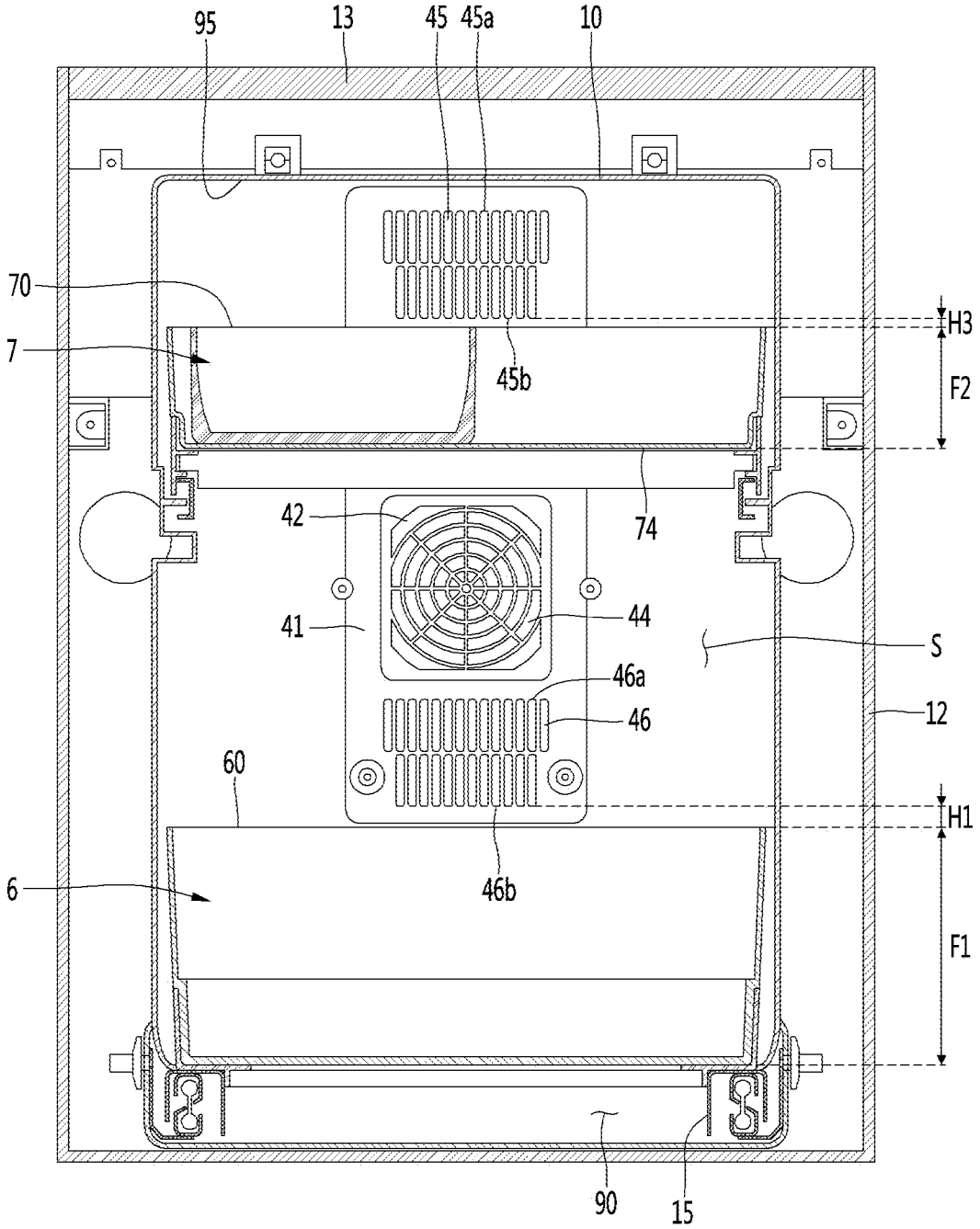
FIG. 20 is a cross-sectional view of a refrigerator according to another embodiment of the present invention.

FIG. 20 is a cross-sectional view of a refrigerator according to another embodiment of the present invention.

A refrigerator according to this embodiment is the same as the embodiment described above except for the position relationship between the upper discharge hole 45 and the second receiving member 7, so the difference is mainly described hereafter without describing the repeated configuration.

The upper discharge hole 45 may be positioned behind and above the second receiving member 7. In more detail, the lower end 45*b* of the upper discharge hole 45 may be positioned behind and above the upper end 70 of the rear surface of the second receiving member 7.

The rear surface 71 of the second receiving member 7 may be disposed to horizontally face the portion between the upper discharge hole 45 and the inner suction hole 44 and the lower discharge hole 45 may not horizontally overlap the second receiving member 7. That is, the second receiving member 7 may be disposed not to horizontally cover the upper discharge hole 45.

The upper discharge hole 45 may face the portion between the top surface of the storage chamber S and the second receiving member 7.

The up-down directional distance between the inner suction hole and the upper discharge hole 45 may be larger than the up-down directional height of the second receiving member 7.

Accordingly, the flow of the low-temperature air that is discharged to the upper discharge hole 45 is not interfered with by the second receiving member 7, so air can smoothly circulate in the storage chamber S. Further, since low-temperature air moves down, it can maintain the food received in the second receiving member 7 at low temperature.

Further, since the air discharged from the upper discharge hole 45 does not hit against the second receiving member 7, there is no need for a curved surface (72, see FIG. 17) on the second receiving member 7, so it is possible to reduce the time and cost for a process that is added to form the curved surface 72.

The upper end 70 of the second receiving member 7 and the lower end 45*b* of the upper discharge hole 45 may be vertically spaced a predetermined distance H3 apart from each other. The vertical spacing distance H3 between the lower end 45*b* of the upper discharge hole 45 and the upper end 70 of the second receiving member 7 may be the same as the first vertical spacing distance H1 between the lower end 46*b* of the lower discharge hole 46 and the upper end 60 of the first receiving member 6. It is preferable that the second vertical spacing distance H3 between the upper end 70 of the second receiving member 7 and the lower end 45*b* of the upper discharge hole 45 is 10 mm or more.

Further, for smoother air circulation in the storage chamber S, the second receiving member 7 may be spaced a predetermined gap apart from the upper discharge hole 45.

The horizontal spacing distance between the rear surface 71 of the second receiving member 7 and the upper discharge hole 45 may be the same as the horizontal spacing distance between the rear surface 61 of the first receiving member 6 and the lower discharge hole 46. The front-rear directional length of the first receiving member 6 may be the same as the front-rear directional length of the second receiving member 7.

Accordingly, as compared with the embodiment described previously above, there is the advantage in that the front-rear directional length of second receiving member 7 can be increased.

The above description merely explains the spirit of the present invention and the present invention may be changed and modified in various ways without departing from the spirit of the present invention by those skilled in the art.

Accordingly, the embodiments described herein are provided merely not to limit, but to explain the spirit of the present invention, and the spirit of the present invention is not limited by the embodiments.

The protective range of the present invention should be construed by the following claims and the scope and spirit of the invention should be construed as being included in the patent right of the present invention.

The invention claimed is:

1. A thermoelectric refrigerator comprising:

a cabinet including an outer cabinet and a back plate;

an inner case having a storage chamber defined therein and disposed in the cabinet adjacent to the back plate;

a door configured to open and close the storage chamber;

a thermoelectric module provided adjacent to the storage chamber and configured to cool the storage chamber;

a heat dissipation cover provided at a rear of the inner case;

a rear heat dissipation channel defined between the back plate and the heat dissipation cover;

a lower heat dissipation channel communicating with the rear heat dissipation channel and defined between the inner case and a lower end of the outer cabinet; and an outlet disposed at a front of the lower heat dissipation channel and opened forward of the outer cabinet, the outlet being configured to discharge air passing through the lower heat dissipation channel.

2. The thermoelectric refrigerator of claim 1, wherein the thermoelectric module includes a thermoelectric element, a heat sink, and a cooling sink that are arranged in a line.

3. The thermoelectric refrigerator of claim 2, further comprising:

a heat dissipation fan that faces to the heat sink; and a cooling fan that faces to the cooling sink.

4. The thermoelectric refrigerator of claim 3, wherein the heat dissipation cover includes at least one outer hole which faces the heat dissipation fan.

5. The thermoelectric refrigerator of claim 3, wherein the heat sink and the heat dissipation fan are disposed in the rear heat dissipation channel.

6. The thermoelectric refrigerator of claim 2, wherein the thermoelectric module further includes a module frame that defines a space that accommodates the thermoelectric element, wherein the module frame comprises a first fastening portion that is coupled to the inner case and configured to fix the module frame on the inner case in a state in which the thermoelectric element is accommodated in the module frame, wherein the inner case comprises a second fastening portion located at a position corresponding to the first fastening portion, and wherein the first fastening portion and the second fastening portion are coupled to each other.

7. The thermoelectric refrigerator of claim 6, wherein the first fastening portion extends outward from a perimeter of the module frame.

8. The thermoelectric refrigerator of claim 6, wherein the first fastening portion has a shape corresponding to the second fastening portion.

9. The thermoelectric refrigerator of claim 2, wherein the thermoelectric module further includes a module frame that defines a space that accommodates the thermoelectric element, wherein the module frame comprises a plurality of first fastening portions that are coupled to the inner case and configured to fix the module frame on the inner case in a state in which the thermoelectric element is accommodated in the module frame, wherein the inner case comprises a plurality of second fastening portions coupled to the plurality of first fastening portions, respectively, and wherein each of the plurality of second fastening portions is positioned to correspond to one of the plurality of first fastening portions.

10. The thermoelectric refrigerator of claim 3, wherein at least a portion of the cooling fan is protruded toward an inside of the inner case, and wherein the heat dissipation fan is disposed in a space between the cabinet and the inner case.

11. The thermoelectric refrigerator of claim 3, further comprising a storage container disposed in the storage chamber, wherein the cooling fan does not face the storage container.

12. The thermoelectric refrigerator of claim 11, further comprising:

a fan cover that covers the cooling fan and has a discharge hole through which air heat exchanged with the cooling sink is discharged into the storage chamber, wherein the air discharged from the discharge hole flows across an upper surface of the storage container.

13. The thermoelectric refrigerator of claim 12, wherein the fan cover is disposed on the inner case to form a portion of the storage chamber, is configured to cover the cooling fan and the cooling sink, and includes a fan accommodation part to accommodate the cooling fan, and the fan accommodation part protrudes toward the storage chamber based on the inner case.

14. The thermoelectric refrigerator of claim 1, further comprising:

a cabinet bottom located inside the cabinet and configured to support the inner case from below, wherein the lower heat dissipation channel is defined between the cabinet bottom and the lower end of the outer cabinet.

15. The thermoelectric refrigerator of claim 14, wherein the outlet is positioned between the door and the lower end of the outer cabinet, and wherein the door is spaced above the cabinet bottom.

16. The thermoelectric refrigerator of claim 15, further comprising a heat dissipation fan and a heat sink, wherein, based on the heat dissipation fan being driven, the air suctioned through at least one outer hole of the heat dissipation cover is guided into the rear heat dissipation channel, the air heated by exchanging heat with the heat sink is guided into the lower heat dissipation channel along the rear heat dissipation channel, and the air guided into the lower heat dissipation channel flows along the lower heat dissipation channel and is discharged to the outlet.

17. The thermoelectric refrigerator of claim 15, further comprising:

a drain pipe that communicates with the storage chamber and is connected to a lower portion of the inner case; and a tray configured to receive water dropped from the drain pipe and positioned below the drain pipe, the tray is arranged between the cabinet bottom and the lower end of the outer cabinet.

18. The thermoelectric refrigerator of claim 3, wherein the cooling fan comprises a fan cover configured to cover the cooling fan and having an upper discharge hole, a lower discharge hole, and an inner suction hole formed between the upper discharge hole and the lower discharge hole.

19. The thermoelectric refrigerator of claim 18, further comprising:

a first receiving member disposed in the storage chamber; and a second receiving member disposed over the first receiving member to be spaced apart from the first receiving member, wherein at least a portion of each of the inner suction hole and the lower discharge hole faces a portion between the first receiving member and the second receiving member, and wherein at least a portion of the upper discharge hole faces a portion between a top surface of the storage chamber and the second receiving member.

* * * * *